US007260352B2

(12) United States Patent
Deguchi et al.

(10) Patent No.: US 7,260,352 B2
(45) Date of Patent: Aug. 21, 2007

(54) FIXING DEVICE CLEANING DEVICE AND IMAGE FORMING DEVICE

(75) Inventors: Masanobu Deguchi, Kashiba (JP); Hiroshi Kida, Yamatokoriyama (JP); Toshiaki Kagawa, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/006,756

(22) Filed: Dec. 8, 2004

(65) Prior Publication Data

US 2005/0207803 A1 Sep. 22, 2005

(30) Foreign Application Priority Data

Dec. 9, 2003 (JP) ..... 2003-410914
Mar. 2, 2004 (JP) ..... 2004-058139

(51) Int. Cl.
*G03G 15/20* (2006.01)

(52) U.S. Cl. ..... 399/327

(58) Field of Classification Search ..... 399/107, 399/122, 320, 327, 328; 15/256.5, 256.51, 15/256.52

See application file for complete search history.

(56) References Cited

U.S. PATENT DOCUMENTS 4,607,947 A * 8/1986 Ensing et al. ..... 399/308
6,215,975 B1 * 4/2001 Berkes et al. ..... 399/327
2003/0223791 A1 12/2003 Akita et al.

FOREIGN PATENT DOCUMENTS

| | | | |
|---|---|---|---|
| JP | 53-013431 A | | 2/1978 |
| JP | 58-203473 A | | 11/1983 |
| JP | 60-51869 | * | 3/1985 |
| JP | 60-104851 A | | 7/1985 |
| JP | 60-216368 A | | 10/1985 |
| JP | 63-168463 U | | 2/1988 |
| JP | 05-113736 A | | 5/1993 |
| JP | 08-016020 A | | 1/1996 |
| JP | 09-127807 A | | 5/1997 |
| JP | 11-065343 A | | 3/1999 |
| JP | 2001-066938 A | | 3/2001 |
| JP | 2001-175105 A | | 6/2001 |
| JP | 2002-304080 A | | 10/2002 |
| JP | 2003-162171 A | | 6/2003 |
| JP | 2003-295658 A | | 10/2003 |
| JP | 2003-302865 A | | 10/2003 |
| JP | 2004-191406 A | | 7/2004 |

* cited by examiner

*Primary Examiner*—Hoan Tran
(74) *Attorney, Agent, or Firm*—Birch, Stewart, Kolasch & Birch, LLP

(57) ABSTRACT

A fixing device cleaning device, provided on a fixing device having a heating member and a pressing member pressed against the heating member at a predetermined contact pressure, comprises a cleaning member, formed in a scraper shape, which is pressed against the heating member, or the pressing member, so as to remove developer from a surface of the heating member or the pressing member. The cleaning member includes one or more opening sections in a vicinity of a contact point with respect to a cleaning target surface of the heating member or the pressing member.

20 Claims, 22 Drawing Sheets

HEAT RECEIVING SURFACE
(ROLLER CONTACT SURFACE)

FIG. 25 PRIOR ART

FIXING DEVICE CLEANING DEVICE AND IMAGE FORMING DEVICE

This Nonprovisional application claims priority under 35 U.S.C. § 119(a) on Patent Application No. 2003/410914 filed in Japan on Dec. 9, 2003 and Patent Application No. 2004/058139 filed in Japan on Mar. 2, 2004, the entire contents of which are hereby incorporated by reference.

FIELD OF THE INVENTION

The present invention relates to a fixing device cleaning device provided with a roller-shape or scraper-shape (blade-shape) cleaning member, and to an electrophotographic image forming device provided with the fixing device having the cleaning device.

BACKGROUND OF THE INVENTION

Conventionally, an electrophotographic image forming device such as an electrophotographic copying machine and a printer is provided with a fixing device. A generally known fixing device, as shown in FIG. 25, includes: a heating roller 501 which is heated by heating means; and a pressing roller 502 pressing the heating roller at a predetermined contact pressure, wherein a recording paper P, on which unfixed developer (for example, toner T) is transcribed by a transcription device provided at a preceding stage of the fixing device so that the unfixed developer is positioned on a surface in the side of the heating roller 501, is made to pass between the heating roller 501 and the pressing roller 502, thereby fixing the unfixed developer on the recording paper.

Further, an example of the electrophotographic image forming device is a color image forming device using developer of plural colors. However, in case of the electrophotographic image forming device, the developer of plural colors is transcribed on the recording paper, so that a thickness of an unfixed developer layer is large. Hence, in the aforementioned conventional fixing device, there occurs such phenomenon that a part of fused developer (or foreign substances such as paper dusts of the recording paper) adheres to the heating roller and the pressing roller.

In order to solve the foregoing problem, there is proposed a cleaning device in which: a roller-shape or scraper-shape (blade-shape) cleaning member is disposed so as to press the heating roller and the pressing roller, thereby removing unnecessary developer and foreign substances that adhere to the heating roller and the pressing roller.

Temperature of the heating roller of the fixing device is controlled so that its surface temperature is kept at set temperature in order to fix the unfixed developer. For example, in case where a softening point of the developer used ranges from 60 to 80° C. and a fusing point of the developer ranges from 130 to 180° C., the set temperature of the surface of the heating roller ranges from 180 to 210° C. In the fixing device using a cleaning roller as the cleaning member, the cleaning roller is directly in contact with the extremely hot surface of the heating roller, so that the surface temperature of the cleaning roller is substantially the same as the set temperature of the surface of the heating roller.

Thus, surface temperature of the cleaning roller exceeds the fusing point of the developer, and the unnecessary developer on the heating roller that has been collected by the cleaning roller is in a fusing state, so that the developer remains on the surface of the cleaning roller.

Therefore, after the cleaning roller collects a predetermined saturated amount of developer, it is impossible to cause the cleaning roller to collect the unnecessary developer from the heating roller, so that the excessive developer remains on the heating roller. This causes the heating roller and the pressing roller to be tainted.

Patent Document 1 (Japanese Publication for Unexamined Publication No. 162171/2003)(Tokukai 2003-162171) (published on Jun. 6, 2003) discloses the following arrangement in order to surely prevent front and rear surfaces of the recording paper from being tainted by surely collecting unnecessary developer from the heating roller and the pressing roller. That is, a fixing device cleaning device includes a pressing roller for pressing a heating roller at a predetermined contact pressure, wherein the cleaning roller (made of metal) is disposed so as to press the heating roller. Further, an axis-direction length of the cleaning roller is shorter than an axis-direction length of the heating roller, and is longer than a maximum width of a sheet.

According to the arrangement, developer which adheres from the recording paper to the heating roller moves from the heating roller to the pressing roller, and is collected by the cleaning roller, at the time of fixing the developer on the recording paper.

In this case, materials of the heating roller surface and the pressing roller surface are appropriately selected, so that it is possible to move substantially all the developer adhering to the heating roller to the pressing roller.

Further, temperature of the pressing roller is lower than temperature of the heating roller, and temperature of the cleaning roller is further lower than the temperature of the pressing roller. Thus, it is possible to make the temperature of the pressing roller lower than the fusing point of the developer.

Thus, the developer remaining on the pressing roller is collected by the cleaning roller with the developer in a semi-fusing state, and the developer is moved outward in the axis directions of both the rollers due to the contact pressure of the pressing roller and the cleaning roller, and the developer is discharged from both ends of the cleaning roller since the length of the cleaning roller is shorter than the length of the pressing roller.

Thus, the developer hardly remains on the surface of the cleaning roller, and substantially all the developer remaining on the surface of the pressing roller which corresponds to the length of the cleaning roller is collected by the cleaning roller.

Further, Patent Document 6 (Japanese Publication for Unexamined Publication No. 113736/1993)(Tokukaihei 5-113736)(published on May 7, 1993) discloses a cleaning roller provided with protruding portions in a spiral manner. When the cleaning roller is used, the protruding portions lead the developer to an axis end of the cleaning roller, thereby discharging the developer.

Further, Patent Document 7 (Japanese Publication for Unexamined Publication No. 66938/2001)(Tokukai 2001-66938)(published on Mar. 16, 2001) discloses a cleaning roller arranged so that: holes are formed on a surface of a metallic cylinder, and the holes are connected to a hollow provided in the metallic cylinder. When the cleaning roller is used, developer which has moved from the fixing roller or the pressing roller and adheres to the cleaning roller is stored into the holes of the cleaning roller, so that it is possible to prevent the developer deposited on the cleaning roller from flowing back to the pressing roller.

Further, each of Patent Document 2 (Japanese Publication for Unexamined Publication No. 104851/1985)(Jitsukaisho 60-104851)(published on Jul. 17, 1985), Patent Document 3 (Japanese Publication for Unexamined Publication No. 203473/1983)(Tokukaisho 58-203473)(published on Nov. 26, 1983), Patent Document 4 (Japanese Publication for Unexamined Publication No. 216368/1985)(Tokukaisho 60-216368)(published on Oct. 29, 1985), Patent Document 5 (Japanese Publication for Unexamined Publication No. 304080/2002)(Tokukai 2002-304080)(published on Oct. 18, 2002), and the like discloses a cleaning device which is arranged so that: a scraper-shape (blade-shape) cleaning member is in contact with the heating roller and the pressing roller, and toner and paper dusts that adhere to the heating roller and the pressing roller are scraped by the cleaning member. FIG. 25 shows a condition under which a scraper-shape (blade-shape) cleaning member 503 is pressed against a pressing roller 502.

Note that, in FIG. 25, the reference sign 504 indicates heating means constituted of a halogen heater or the like and the reference sign Y indicates a fixing nip. Further, FIG. 26 is a front view of the scraper 503, and the reference sign N indicates a position at which the scraper 503 and the pressing roller 502 are in contact with each other, and the reference sign Wp indicates a maximum width of the recording paper P.

However, according to the fixing device using the cleaning roller recited in Patent Documents 1 and 6, in case of using an image forming device which covers a paper having a large maximum width or in case of sequentially printing images (for example, in case of printing images on a large amount of sheets) by using a high speed machine in order to sequentially print images on wide recording papers such as A3-size recording papers for example, a pace at which the developer is discharged from both ends of the cleaning roller tends to be slow.

Thus, even in case of printing images right after turning ON the power source, the developer remaining on the cleaning roller returns from the cleaning roller to the pressing roller, so that the developer taints front and rear surfaces of a sheet on which an image has been formed. It was clarified that this phenomenon is conspicuous particularly in double-side printing based on image data whose printing ratio is high.

Further, the cleaning roller of Patent Document 7 which is formed in a cylindrical shape is in contact with another cylindrical roller, so that its scraping performance is lower than the case of using the scraper recited in Patent Documents 2 to 5.

Further, according to the fixing device using the scraper as shown in Patent Documents 2 to 5, it is necessary to surely bring the edge portion E of the scraper (blade) 503 into contact with a surface of the fixing member such as the heating roller 501 and the pressing roller 502, as shown in FIG. 27, in order to obtain a sufficient scraping performance. However, lot unevenness occurs due to size unevenness of parts, thermal deformation of parts, and the like, so that it is difficult to always stably bring the edge portion E of the scraper 503 into contact with the fixing member.

Particularly, in case where the scraper 503 and a holding member 505 for holding the scraper 503 are different from each other in terms of a coefficient of thermal expansion, the scraper 503 swings due to the thermal expansion, so that it is difficult to evenly bring the scraper 503 into contact with the fixing member also in a width direction.

Further, the edge portion E of the scraper 503 breaks into the fixing members so that the surface of the fixing member is damaged, and there is limit in making a thickness of the scraper 503 thinner. This results in such problem that: a high pressure at which the scraper 503 is pressed is likely to wear out the surface of the pressing roller 502.

Further, in the scraper-type cleaning device, the scraped toner and paper dusts remain an end of the scraper 503, so that a toner puddle DM1 is formed (FIG. 27). Further, when the toner puddle DM1 grows, the toner and the paper dusts move (flow) from the toner puddle DM1 to the surface of the fixing member, so that the recording paper P is tainted.

In order to prevent the toner puddle DM1 from flowing and tainting the fixing member, Patent Document 5 discloses a technique for preventing the toner puddle DM1 formed on an end of the blade from flowing to the fixing member by providing deformation following means which is brought into contact with a deformed portion of a pressed area (fixing nip portion Y) of the fixing member in a stoppage state so that the deformation following means follows the cleaning blade in a rotation state.

However, the toner adhering to the fixing member such as the heating roller, the pressing roller, and the like is fused by heat of the fixing member, so that it is difficult to completely scrape the toner D that has been fused and fixed on the surface of the fixing member even when the edge portion E of the scraper 503 is brought into contact with the fixing member as shown in FIG. 27. Thus, a part of the toner escapes from the edge E, and the toner adheres and is deposited on a scraper face S2 positioned in a vicinity of downstream with respect to the edge portion E. As a result, a second toner puddle DM2 is formed. Likewise, the paper dusts are mixed with the fused toner D, so that the paper dusts escape from the blade. Thus, the paper dusts are absorbed by the second toner puddle DM2.

As a result, the toner and the paper dusts flow from the second toner puddle DM2 to the surface of the fixing member, so that the recording paper P is tainted.

Particularly, in case where recording papers smaller than a width of the fixing member are subsequently made to pass, the toner puddle DM2 is fused and flows due to abnormal rise of temperature in an area which does not allow a paper to pass (non-paper passing area) in the fixing member. When a recording paper having a larger size is allowed to pass thereafter, the recording paper is conspicuously tainted.

Further, according to the cleaning device of Patent Document 4, a surface of a cleaning blade which is less likely to be released than the fixing member is brought into contact with the fixing member, so that it is possible to clear the toner without bringing an edge portion of the cleaning blade into contact with the fixing member. Moreover, the heating roller and the pressing roller are disposed so that they can be disconnected or connected, and displacement of the pressing roller which occurs in disconnection or connection of both the rollers causes a bending amount of the cleaning blade to change, thereby exfoliating and dropping the toner puddle DM2 adhering to the cleaning blade.

However, in case where the surface of the cleaning blade is brought into contact with the fixing member, the cleaning performance greatly drops compared with the case where the edge portion of the cleaning blade is brought into contact with the fixing member. In this case, it is necessary to provide the pressing roller so that the pressing roller can be disconnected and connected from and to the heating roller, so that the device is complicated.

SUMMARY OF THE INVENTION

The object of the present invention is to provide a fixing device cleaning device which is capable of being evenly and stably in contact with a fixing member and gives less damage to the fixing member and prevents a recording paper from being tainted with flowing toner puddle and is arranged in a simple manner.

The fixing device cleaning device of the present invention is provided on a fixing device which includes: a heating member heated by heating means; and a pressing member pressed against the heating member at a predetermined contact pressure, and a recording sheet is sandwiched by a pressing section of the heating member and a pressing section of the pressing member, and developer on the recording sheet is fixed, and the fixing device cleaning device includes a cleaning member, formed in a scraper shape, which is pressed against the heating member or the pressing member so as to remove the developer from a surface of the heating member or the pressing member, wherein the cleaning member includes one or more opening sections in a vicinity of a contact point with respect to a cleaning target surface of the heating member or the pressing member.

According to the arrangement, foreign substances scraped by the cleaning member move to a surface (a rear surface with respect to a surface which is in contact with the cleaning target surface) of the cleaning member via the opening sections, so that the foreign substances are not deposited on a gap between the cleaning member and the cleaning target surface, thereby preventing the deposited foreign substances from adhering to the cleaning target surface again.

Further, generally, the opening section causes the cleaning member made of elastic material to less spring, so that it is possible to bring the cleaning member into contact with the pressing member at a lower pressure than that of a conventional technique, thereby reducing a load exerted to the cleaning target surface.

Further, even when the cleaning member thermally expands, the thermal expansion is absorbed by the opening section, so that it is possible to prevent the cleaning member from being swung by heat, thereby stably bringing the whole width of the cleaning member into contact with the cleaning target surface.

For a fuller understanding of the nature and advantages of the invention, reference should be made to the ensuing detailed description taken in conjunction with the accompanying drawings.

BRIEF DESCRIPTION OF THE DRAWINGS

FIG. 8(*b*) illustrates a case where the concaved portion (continuous line) at the second rotation is positioned between two concaved portions (broken line), adjacent to each other, which occur at the first rotation of the pressing roller, when the same cleaning roller is used.

FIG. 10(*b*) illustrates a relationship among the foregoing widths and length in case where the concaved portions are formed in a spiral manner. FIG. 10(*c*) is a front view showing a cleaning roller in which the concaved portions are formed in a ring-groove manner. FIG. 10(*d*) is a front view showing a cleaning roller in which the concaved portions are formed in a spline manner.

FIG. 11(*b*) is a longitudinal sectional view showing another example of the concaved portion.

DESCRIPTION OF THE EMBODIMENTS

Embodiment 1

The following description will explain one embodiment of the present invention with reference to attached drawings. Here, the fixing device is a device for fixing an image of developer (for example, toner) transcribed on a recording sheet (for example, paper or the like) with heat and pressure. Thus, the image is recorded on a recording material. Further, the fixing device includes a pressing roller, a heating roller, and a cleaning roller, that are provided therein.

Figure 1:
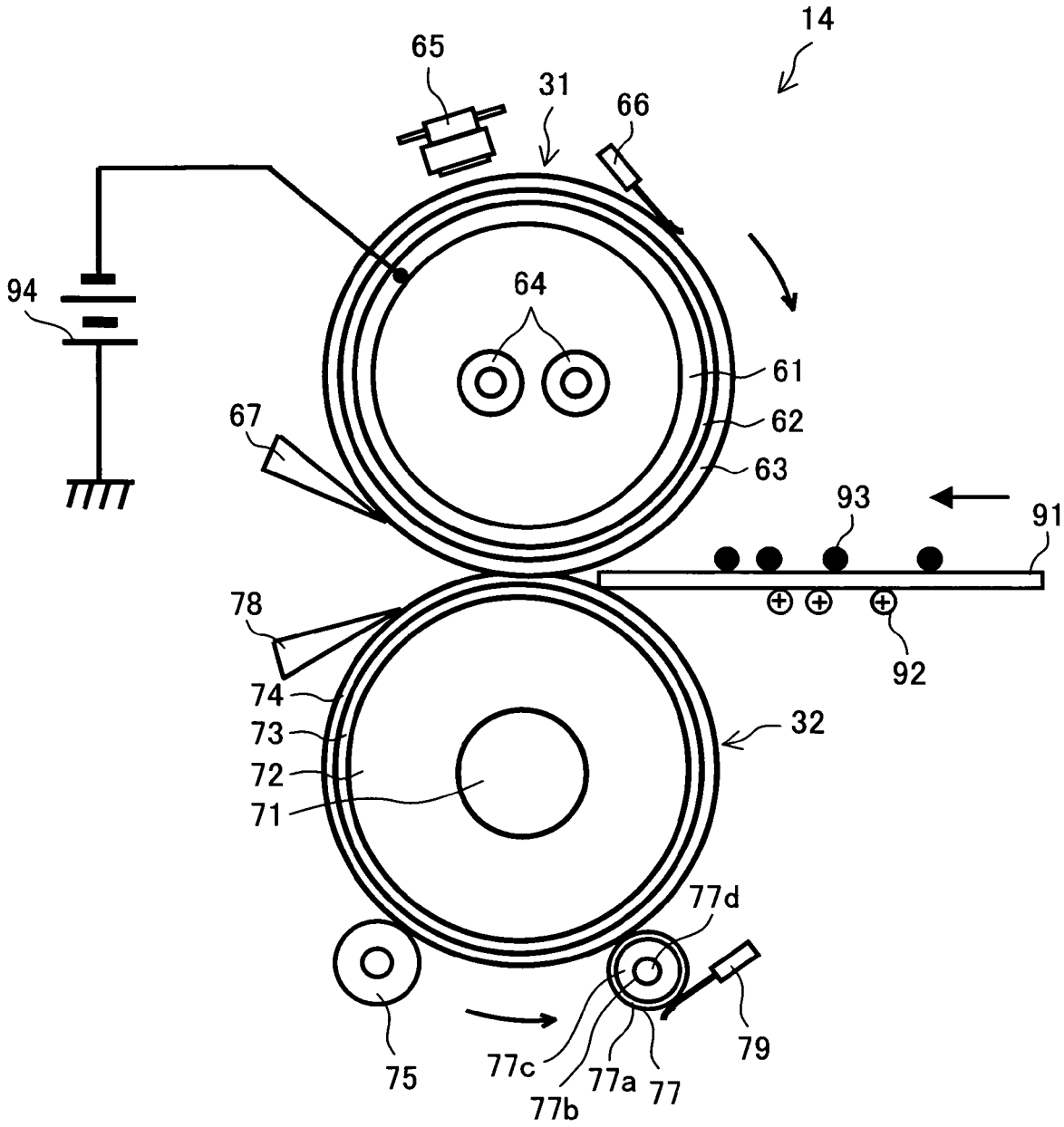
FIG. 1 is a longitudinal sectional view schematically showing a fixing device of one embodiment of the present invention.

FIG. 1 shows a structure of the fixing device 14 in detail. FIG. 1 is a longitudinal sectional view schematically showing the fixing device 14. In the fixing device of FIG. 1, a fixing roller 31 formed in a roller shape has a conductive plug 61 therein, and a fixing roller 32 formed in a roller shape has a conductive plug 71 therein.

The fixing roller 31 contains large amounts of aluminum,, iron, and alloy thereof. In the present embodiment, the fixing roller 31 is manufactured as follows: an iron cold-rolling carbon steel tube is drawn or is subjected to a similar process so as to have a desired external diameter and a desired thickness, and is then subjected to a grinding process so as to have an external diameter of 40 mm and a thickness of 1.3 mm. Each of both ends of the fixing roller 31 is subjected to a drawing process so as to have an external diameter of 30 mm and a thickness of 1.5 mm, and a load exerted to the fixing roller 31 is supported by a ball bearing (a kind of a roller bearing) which functions as an axis supporting member. The plug 61 of the fixing roller 31 is subjected to a parkerizing process (phosphate coating process) so that its material surface is not oxidized, thereby suppressing oxidization.

The fixing roller 31 has a central sleeve portion which is not subjected to the drawing process, and fluorine resin which keeps a releasing property even in case of being in contact with thermally fused toner is generally used as a material for the central sleeve portion. Examples of the fluorine resin include PFA (tetrafluoroethylene perfluoroalkylvinyl ether copolymer), PTFE (polytetrafluoroethylene), and an alloy thereof. The conductive plug 61 is coated via an intermediate layer 62 with the fluorine resin as a surface insulating layer 63.

As the surface insulating layer 63, in terms of a heat resistance and a releasing property, it is possible to use either fluorine resin such as tetrafluoroethylene/hexafluoropropylene copolymer (FEP), ethylene/tetrafluoroethylene copolymer (ETFE), polychlorotrifluoroethylene (PCTFE), ethylene/chlorotrifluoroethylene copolymer (ECTFE), poly vinylidene fluoride (PVDF) or a material containing fluorine rubber latex, or it is possible to use a combination of two or more kinds of the foregoing materials. The surface insulating layer 63 is formed by applying and sintering each of these materials, or by forming a tube coating film, or in a similar manner.

The intermediate layer 62 improves a bonding property between the fluorine resin which functions as the surface insulating layer 63 and a surface of the carbon steel tube which is subjected to the parkerizing process. In the present embodiment, insulating primer such as rubber or resin adhesive is used. Note that, as the intermediate layer 62, not only the insulating primer but also conductive primer can be used.

Further, a heat resistance endoergic layer is formed in the fixing roller 31. In case where the halogen lamp 64 which functions as a heater in the fixing roller 31 emits radiant energy such as an infrared ray to an inside surface of the fixing roller, the heat resistance endoergic layer efficiently absorbs the radiant energy and converts thus absorbed radiant energy. The heat resistance endoergic layer is formed by applying and drying a mixture of modified silicone resin, inorganic heat resistance black pigment, hydrocarbon (solvent) and the like, so as to have a thickness of 20 to 30 μm. Generally, heat resistance coating material such as Okitsumo (commercial name), Tetzsol (commercial name), and ThermoBlack (commercial name) is used. In the present embodiment, Okitsumo is used.

Note that, in the fixing roller 31, the reference sign 66 indicates a thermistor which is a temperature detection element for detecting a surface temperature of the fixing roller 31. The reference sign 65 indicates a thermostat which functions as means for preventing excessive temperature rise. Further, the reference sign 67 indicates an upper exfoliating portion for mechanically exfoliating the recording material 91 from the fixing roller 31, and the reference sign 78 indicates a lower exfoliating portion for mechanically exfoliating the recording material 91 from the pressing roller 32.

Figure 2A:
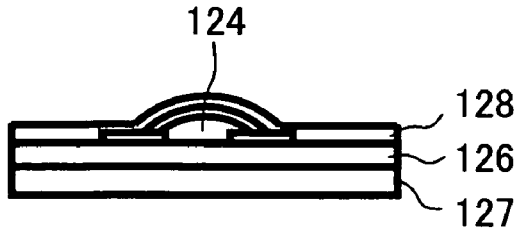
FIG. 2(*a*) is a front view of a thermistor provided on a fixing roller shown in FIG. 1, and FIG. 2(*b*) is a plan view of the thermistor.
Figure 2B:
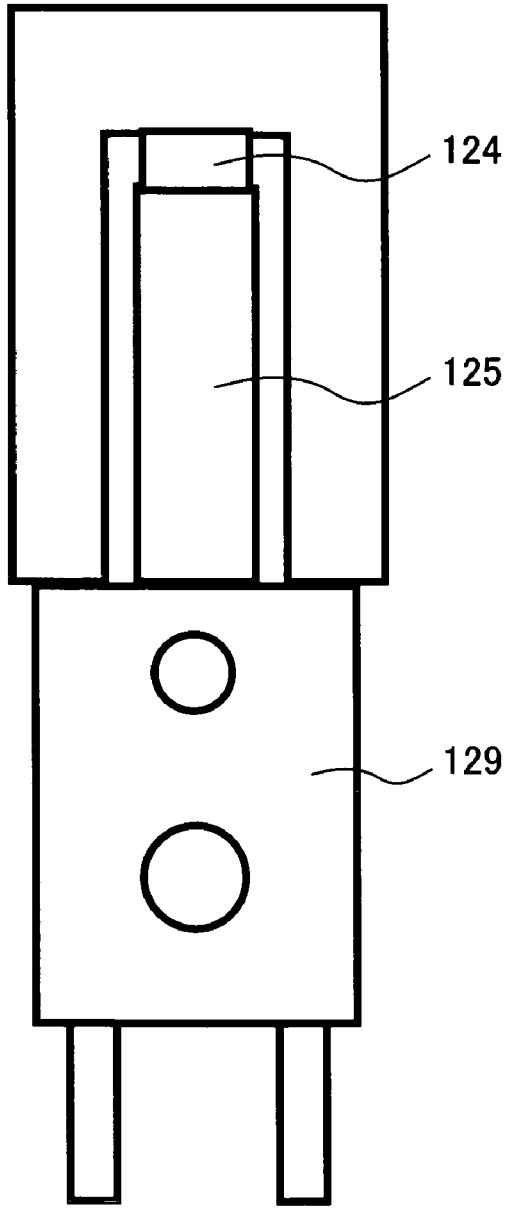

Note that, as shown in FIG. 2(*a*) and FIG. 2(*b*), the thermistor used in the present embodiment is arranged so that: a thermistor chip 124 is bonded directly to a stainless plate 125 which is an elastic member fixed and supported by a housing 129 so as to improve its thermal response. When a bias voltage is applied to the thermistor, the thermistor is in contact with the fixing roller 31, the pressing roller 32, and the heating roller 77, that have high potentials due to frictional charge, so that it is necessary to protect an electric system such as a temperature control device and an image forming device from a high voltage. Particularly, the stainless plate and each of the rollers are positioned near to each other, so that it is necessary to sufficiently secure a withstand voltage with respect to a secondary circuit of the temperature control device.

Thus, the thermistor of the present embodiment is arranged so that: the insulating coating layer 126 is provided on a heat receiving side of the stainless plate 125 bonded to the thermistor chip 124, and a heat resistance releasing layer 127 is provided on the insulating coating layer 126. Further, a protective layer 128 is provided on a rear side with respect to the heat receiving side. Further, in order to secure an insulating distance between the roller surface and the stainless plate 125 above an area extending from the stainless plate 125 to the housing 129, the insulating coating film 126, the heat resistance releasing layer 127, and the protective layer 128 cover the stainless plate 125 so as to extend to a vicinity of a border of the housing 129. This arrangement causes a leak current not to flow from each roller to the thermistor chip 124 and the stainless plate 125, thereby solving disadvantages such as damage and deterioration caused by a high voltage. As a result, it is possible to apply a stable bias voltage, and it is possible to obtain exact temperature information, thereby favorably controlling the temperature.

In the present embodiment, the insulating coating layer 126 is made of polyimide, containing adhesive, whose thickness is 50 μm (commercial name: Kapton), and the heat resistance releasing layer 127 is formed by impregnating glass fiber, containing adhesive, whose thickness is 130 μm, with heat resistance releasing resin. Further, the protective layer 128 is made of teflon (registered trademark), containing adhesive, whose thickness is 80 μm. Note that, materials of these members are not limited to the foregoing materials, but any other material may be used as long as the material can be substituted in terms of properties.

The pressing roller 32 is arranged so that: the insulating elastic layer 72 such as silicone rubber having heat resistance is formed on the conductive plug 71 made of iron, stainless, and the like, and the intermediate layer 73 is formed on a periphery of the insulating elastic layer 72. A surface resistance layer 74 for improving the releasing property of the surface is formed on a periphery of the intermediate layer 73. The intermediate layer 73 improves the bonding condition between the insulating elastic layer 72 and the surface resistance layer 74. In the present embodiment, insulating primer is used as the intermediate layer 73 to be bonded to the insulating elastic layer 72.

The surface resistance layer 74 of the pressing roller 32 uses $10^{10}\Omega$ as a surface resistance ratio. Although the surface resistance layer 74 can be used at $10^{5}\Omega$, it is preferable to use a surface resistance ratio ranging from $10^{7}\Omega$ to not less than $10^{18}\Omega$. Further, a volume resistance ratio is not less than $10^{7}\Omega\cdot$cm, preferably, not less than $10^{10}\Omega\cdot$cm.

As a material for the insulating elastic layer 72, it is possible to use high temperature vulcanization type silicone rubber (HTV), additional reaction curing type silicone rubber (LTV), condensation reaction curing type silicone rubber (RTV), fluorine rubber, or a mixture thereof, as long as the material is silicone rubber. Specifically, it is possible to use: silicone rubber such as dimethylsilicone rubber, phlorosilicone rubber, methylphenylsilicone rubber, and vinylsilicone rubber; and fluorine rubber such as vinylidene fluoride rubber, tetrafluoroethylene-propylene rubber, tetrafluoroethylene-perfluoro methyl vinyl ether rubber, phosphagen fluorine rubber, and fluoropolyether, for example. The rubber can be used as a single material or in combination of two or more kinds, and is molded by casting/vulcanizing, grinding, or a similar process.

Figure 3:
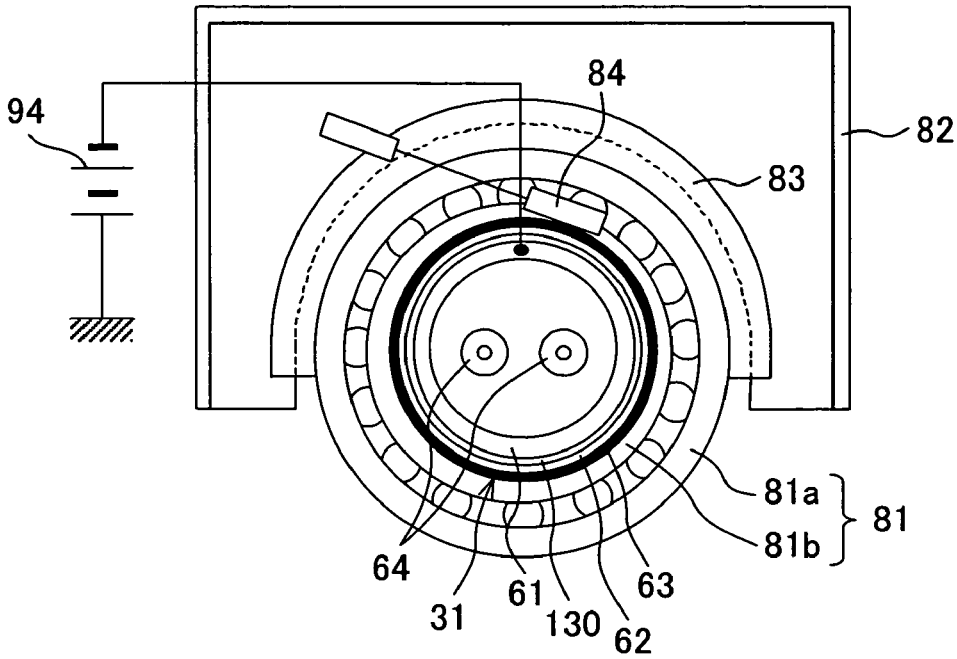
FIG. 3 is a front view of a support structure of a fixing roller of one embodiment of the present invention.
Figure 4:
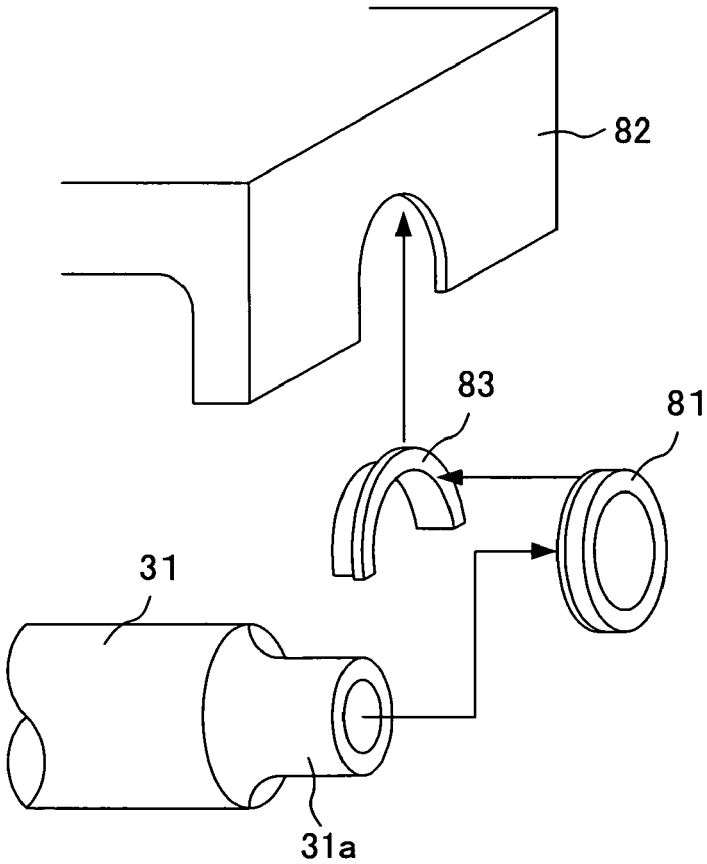
FIG. 4 is an exploded perspective view of the support structure of the fixing roller shown in FIG. 5.

FIG. 3 is a front view showing a support structure of the fixing roller 31, and FIG. 4 is a decomposed perspective view of the support structure of the fixing roller 31. As shown in FIG. 3 and FIG. 4, the fixing roller 31 is supported by the ball bearing 81 provided on a frame 82 of the fixing device 14. The frame 82 is obtained by press-molding an iron cold-rolling steel. The frame 82 is provided on a frame of the image forming device 41 for example. The ball bearing 81 includes an outer ring portion 81*a*, a rolling element (not shown), and an inner ring portion 81*b*, and is fitted to a journal portion 31*a* positioned in a drawing portion of each of both ends of the fixing roller 31.

The pressing roller 32 is arranged so that: a ball bearing (not shown) is fitted to an axis portion of stainless or the like, and the ball bearing is received by a load lever extending from a fulcrum axis, with which the frame is caulked, so as to be loaded in a central axis direction of the fixing roller 31 by a load spring or the like. A pressure exerted by the load is 764N (total of both ends) in the present embodiment, but it is possible to arbitrarily set the pressure depending on a type of the recording material 91, rigidity of the fixing roller 31 and the pressing roller 32, conditions such as an adjusted temperature, and performances.

Further, as to the rolling element positioned between the outer ring 81*a* and the inner ring 81*b* of the ball bearing 81, it is general that: metallic contact between bearing materials is minimized so as to keep the rolling friction at low level, so that a driving force required in the rolling is minimized, thereby supporting the load. However, merely the contact between metals results in burn due to the effect of the rolling friction. In order to avoid such disadvantage, lubricant (Gris) whose main component is silicone or fluorine oil is injected into a gap between the outer ring 81*a* and the inner ring 81*b* so that the metal contact does not cause the burn.

As described above, the fixing device 14 is arranged so that: a fixing bias voltage is applied to the fixing roller 31 via the ball bearing 81, and the fixing roller 31 and the pressing roller 32 are pressed again each other at a predetermined pressure, and unfixed image of toner is thermally fused while transporting the recording material 91 with it sandwiched, thereby fixing the image on the recording material 91.

Note that, materials, sizes, and shapes are not limited to them that are adopted in the present embodiment, but various modification is possible and various materials, sizes, and shapes can be adopted so as not to depart from the desired performances.

Further, as shown in FIG. 1, the fixing device 14 of the present embodiment is arranged so that: in a periphery of the pressing roller 32, the cleaning roller 75 which functions as a cleaning member and the heating roller 77 which functions as a second heating member are brought into contact with each other. Note that, as in the reference sign 66, the reference sign 79 indicates a thermistor which functions as a temperature detection element for detecting a surface temperature of the heating roller 77.

The cleaning roller 75 is made of aluminum, iron, or alloy thereof (including stainless steel), and is formed by processing a hollow roller or a solid-core roller so that a sliding bearing or a rolling bearing is fitted to each of both ends thereof, and is pressed against the pressing roller 32 by a loading spring or the like with a predetermined nip kept. In the present embodiment, the cleaning roller 75 is made of carbon steel or stainless steel, and its external diameter is 15 mm. In order to clear toner slightly remaining on a surface of the pressing roller 32, predetermined roughness is given to a surface of the cleaning roller 75.

While, the heating roller 77 is a hollow roller made of aluminum, iron, or alloy thereof (including stainless steel), and is processed by causing heat conduction of a nip in being pressed against the pressing roller 32 to heat a surface of the heating roller 77 while maintaining the releasing property by means of a surface releasing layer 77*a* provided on an outermost periphery of the heating roller 77. In the present embodiment, an intermediate layer 77*c* and the surface releasing layer 77*a* are sequentially formed on an external surface of a straight pipe 77*b*, made of aluminum alloy, whose external diameter is 15 mm and thickness is 0.85 mm, and a heat resistance heat absorbing layer is provided on an internal surface of the straight pipe 77*b* as in the fixing roller 31, and a halogen lamp 77*d* is provided therein.

In the heating roller 77, it is possible to arrange the intermediate layer 77*c* and the surface releasing layer (surface insulating layer) 77*a* in a manner different from the fixing roller 31, but they are arranged in the same manner in the present embodiment. Further, also the heating roller 77 is arranged so that a sliding bearing or a rolling bearing is fitted to each of both ends thereof, and is pressed against the pressing roller 32 by a loading spring or the like with a predetermined nip kept.

As shown in FIG. 1, in order to give a potential difference so that reverse polarity toner 92 which is likely to adhere to a rear surface of the recording material 91 is retained on the recording material 91, a bias voltage is applied from the bias device 94 to the fixing roller 31. In the present embodiment, a transcription device 5 carries out contact-transcription, and may be formed in a belt shape though the transcription device 5 is in a roller shape in FIG. 14. Note that, in FIG. 1, the toner 93 adhering to the recording material 91 so as to be positioned on the side of the fixing roller 31 is toner which constitutes an image.

Here, the transcription device 5 is positioned on the upstream side with respect to the fixing device 14 in a flow path of the recording material 91, and carries out a transcription process for transcribing a toner image which is an electrostatic visualized toner image formed on a photosensitive drum 1. At this time, the reverse polarity toner 92 adheres to a surface of the transcription device 5, and further adheres to a rear surface of the recording material 91 via the surface of the transcription device 5.

Generally, the transcription device 5 cannot completely remove the reverse polarity toner and paper dusts though the transcription device 5 includes a mechanism for removing the reverse polarity toner and the paper dusts, so that the remaining reverse polarity toner and paper dusts are deposited on the surface of the transcription device 5. Further, the reverse polarity toner and paper dusts partially or entirely adheres to the recording material 91 due to a condition such as an electrical or mechanical adherent force, and are carried to the fixing device 14 in the downstream side.

Figure 14:
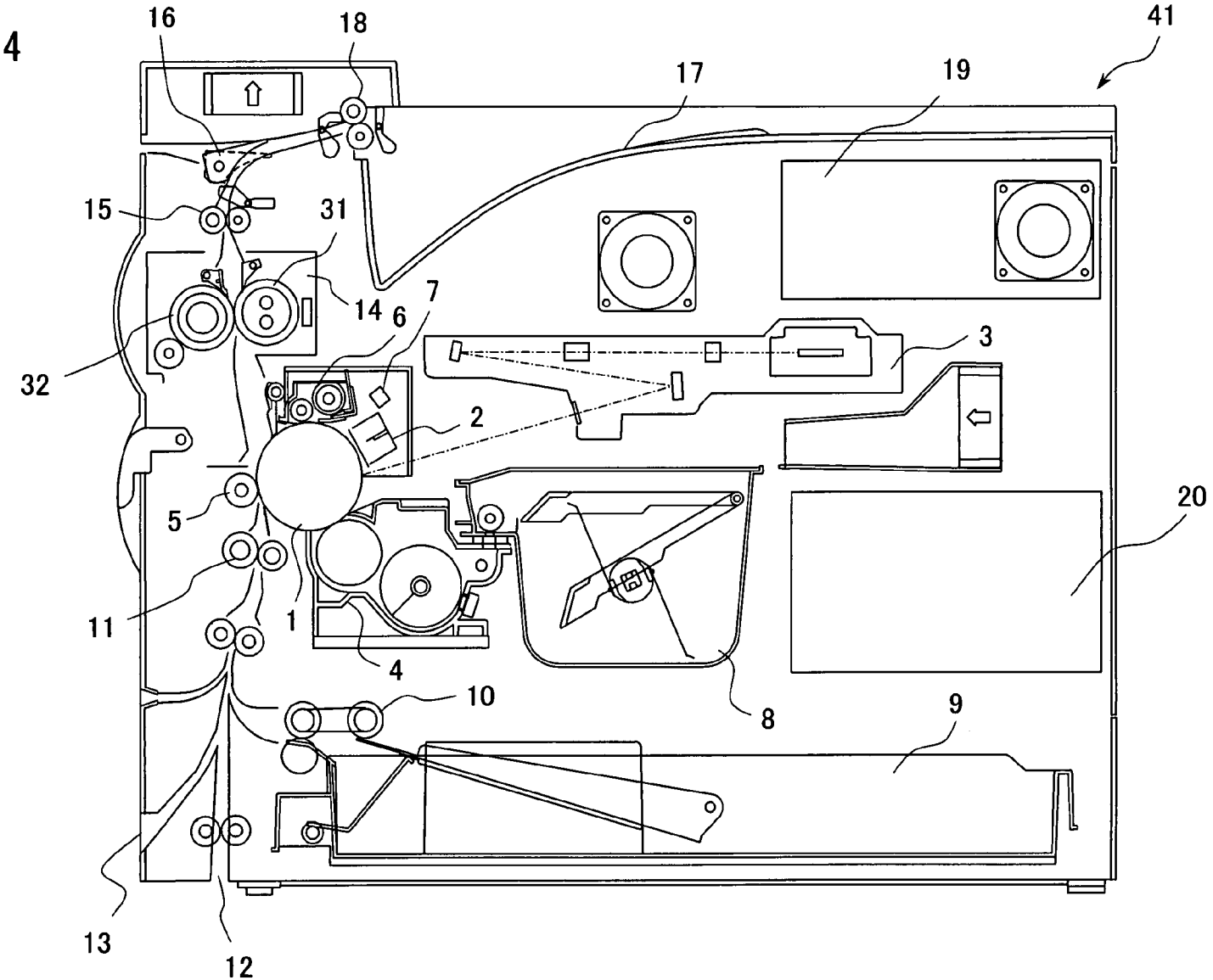
FIG. 14 is a front view showing an internal structure of an electrophotographic image forming device provided with the fixing device shown in FIG. 1.

Usually, the reverse polarity toner 92 and paper dusts adhere to the recording material 91 and are discharged together the recording material 91 from the image forming device 41 (see FIG. 14). However, according to the conventional fixing device 14, in case where a large number of sheets are subjected to a fixing process, the reverse polarity toner 92 is exfoliated from the recording material 91 due to conditions of the fixing device 14, particularly, due to electrostatic intensity, polarity, and the like, that are caused by frictional charging of the fixing roller 31 and the pressing roller 32, so that the reverse polarity toner and paper dusts adhere to the pressing roller 32 and the fixing roller 31. As a result, an image is insufficiently or defectively printed on a front or rear surface of the recording material 91.

Thus, the fixing device 14 of the present embodiment applies a fixing bias voltage, having a polarity (for example, negative polarity) adverse to a charging polarity (for example, positive polarity) of the reverse polarity toner 92, to the conductive plug 61 of the fixing roller 31.

According to the arrangement, due to the fixing bias voltage applied from the bias device 94 to the plug 61 of the fixing roller 31, the electrostatic force which causes the reverse polarity toner 92 on the rear surface of the recording material 91 to be retained on the rear surface of the recording material 91 acts. Thus, the reverse polarity toner 92 on the rear surface of the recording material 91 remains on the recording material 91 without being exfoliated toward the pressing roller 32. As a result, the reverse polarity toner 92 is fixed on the rear surface of the recording material 91, and is discharged together the recording material 91 from the image forming device 41. Note that, an amount of the reverse polarity toner 92 on the recording material 91 is small for each sheet of the recording material 91, so that the fixed image is hardly influenced.

However, when images are sequentially printed on a large number of sheets under such condition that a process speed is 335 mm/s and a printing speed is 55 to 65 sheets per second and temperature of the heating roller 31 is set to 180° C., the surface temperature of the pressing roller rises to approximately 100° C. This results in such condition that the temperature is lower than the toner fusing point 120° C. and higher than the toner softening point 70° C., so that the toner adheres to the pressing roller though a bias is applied to the pressing roller 32.

When the toner moves to the rear surface of the recording material 91 again after the toner adhering to the pressing roller 32 is deposited, the image quality is deteriorated. In order to prevent the toner from being deposited on the surface of the pressing roller 32, the cleaning roller 75 is disposed on the downstream side in the fixing nip, the toner remaining on the pressing roller 32 moves and adheres to the surface of the cleaning roller 75, and the surface of the pressing roller 32 is cleaned, thereby keeping the favorable image quality.

However, it was found that: even though the cleaning roller 75 is provided, it is difficult to keep the favorable image quality over the whole life of the device.

That is, in a device whose printing volume is large such as a high-speed machine, when an amount of the toner deposited on the cleaning roller 75 is large, toner particle clot is formed, so that the pressing roller 32 and the cleaning roller 75 are in uneven contact with each other. Further, in case where idle running is carried out without any recording paper or in case where images are sequentially printed on small-size sheets, in an area away from a sheet passing are, the surface temperature of the pressing roller 32 rises to 140 to 160° C. which exceeds the fusing point of the toner. Thus, the toner particle clot deposited on the surface of the cleaning roller 75 is exfoliated from the cleaning roller 75 and adheres to the pressing roller 32, and is fixed on the rear surface of the recording material 91, so that image quality is deteriorated.

Figure 5:
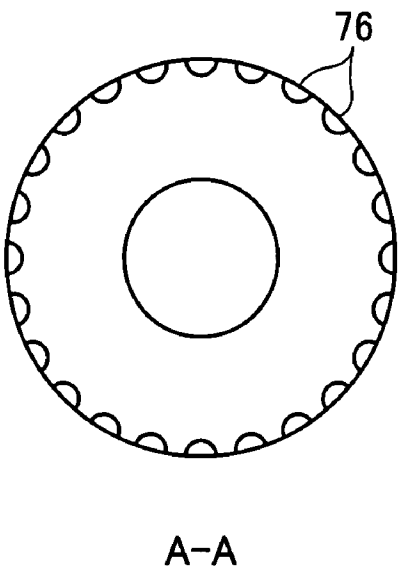
FIG. 5(*a*) is a front view showing an important portion of a cleaning roller shown in FIG. 1, and FIG. 5(*b*) is a cross sectional view taken along A-A of FIG. 5(*a*).
Figure 5:
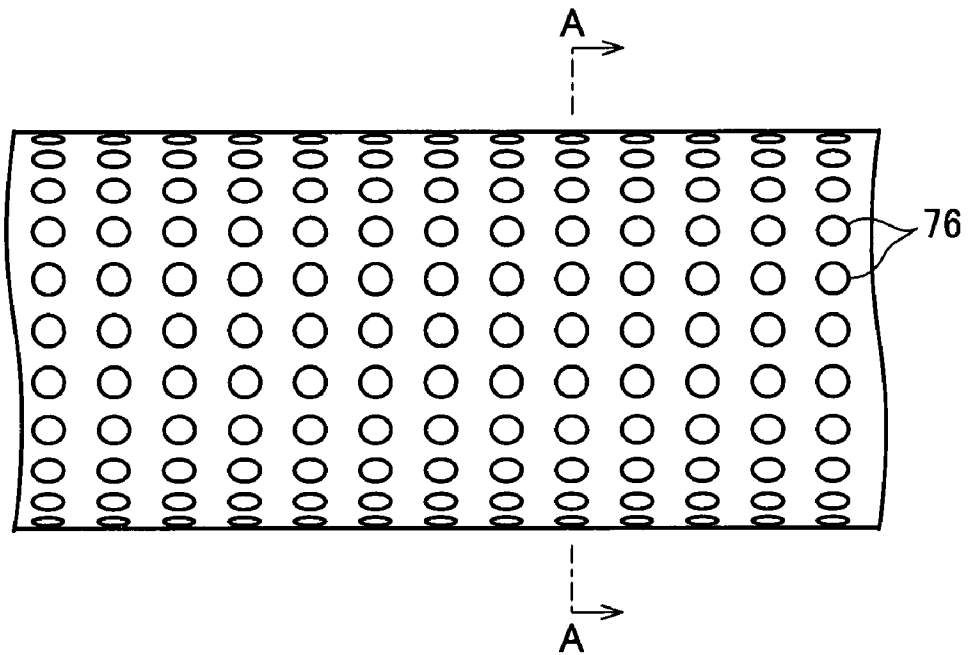

Thus, the fixing device 14 of the present embodiment is arranged so that: in order to prevent the toner from being deposited and growing on the surface of the cleaning roller 75, concaved portions 76 are formed on the surface of the cleaning roller 75 as shown in FIGS. 5(*a*) and 5(*b*). Note that, FIG. 5(*a*) is a front view showing an important portion of the cleaning roller 75, and FIG. 5(*b*) is a cross sectional view taken along A-A of FIG. 5(*a*).

Figure 6A:
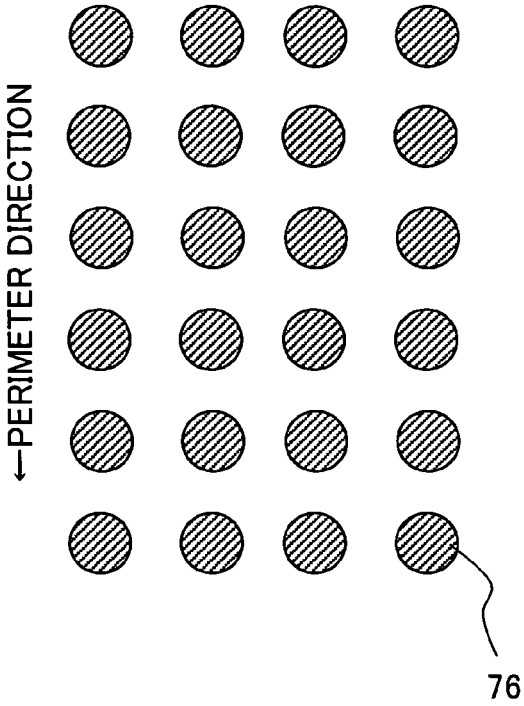
FIG. 6(*a*) illustrates a layout of concaved portions of the cleaning roller shown in FIG. 1, and FIG. 6(*b*) illustrates other concaved portions which are different from the concaved portions of FIG. 6(*a*).
Figure 6B:
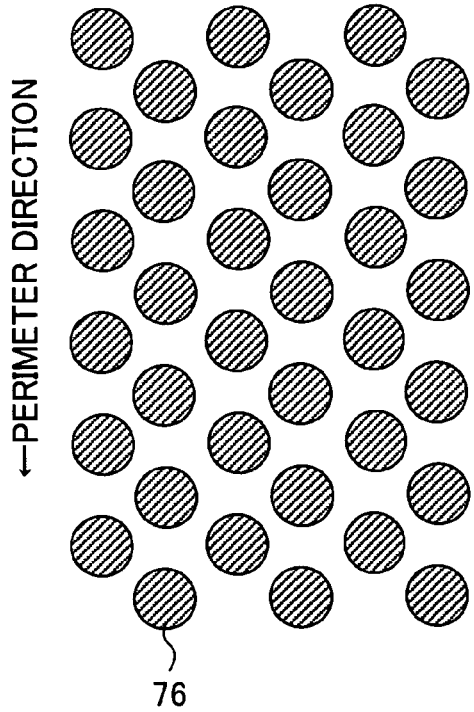

Each of FIGS. 6(*a*) and 6(*b*) shows an example of layout of the concaved portions 76 formed on the cleaning roller 75. The figure shows a condition under which the surface of the cleaning roller 75 having the concaved portions 76 is developed in a perimeter direction. Note that, in the figure, the concaved portion 76 is formed in a circular shape, but the shape is not limited to this. The concaved portion 76 may be formed in an oval shape or polygonal shape. That is, the shape is not particularly limited.

In FIG. 6(*a*), the concaved portions 76 are disposed in straight lines orthogonal to each other. Specifically, the concaved portions 76 are disposed straight in an axis direction of the cleaning roller 75 and in a direction orthogonal to the axis direction. In FIG. 6(*b*), the concaved portions 76 are disposed in a staggered manner. In other words, the concaved portions 76 are formed so as to be alternately positioned in arbitrary two rows adjacent to each other and in arbitrary two columns adjacent to each other. Here, as to the layout of the concaved portions 76, it is more preferable to arrange the concaved portion 76 in a staggered manner out of both the examples. The reason for this is explained as follows with reference to FIGS. 7(*a*) and 7(*b*).

Figure 7A:
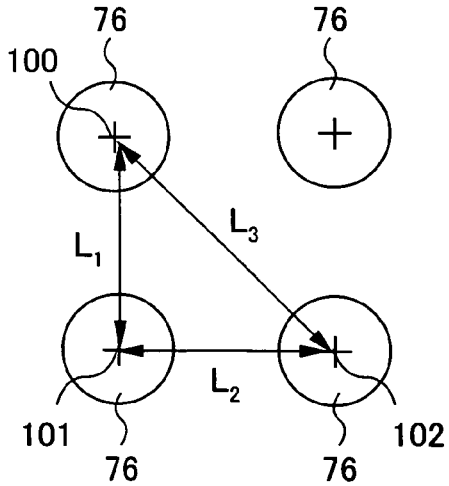
FIG. 7(*a*) illustrates a distance between a concaved portion and an adjacent concaved portion that are shown in FIG. 6(*a*), and FIG. 7(*b*) illustrates a distance between a concaved portion and an adjacent concaved portion that are shown in FIG. 6(*b*).
Figure 7B:
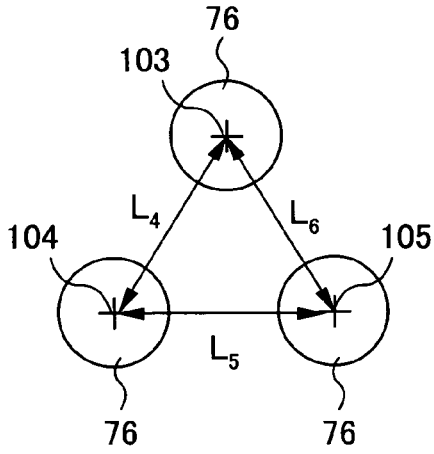

FIG. 7(*a*) shows a condition under which centers of three concaved portions 76 of FIG. 6(*a*) that are adjacent to each other are connected by straight lines, and FIG. 7(*b*) shows a condition under which centers of three concaved portions 76 of FIG. 6(*b*) that are adjacent to each other are connected by straight lines likewise.

In FIG. 7(*a*), the centers of three concaved portions adjacent to each other are respectively 100, 101, and 102, and a distance between the center 100 and the center 101 is L1, and a distance between the center 101 and the center 102 is L2, and a distance between the center 100 and the center 102 is L3. Further, in FIG. 7(*b*), likewise, the centers of three concaved portions adjacent to each other are respectively 103, 104, and 105, and a distance between the center 103 and the center 104 is L4, and a distance between the center 104 and the center 105 is L5, and a distance between the center 105 and the center 103 is L6. In case of FIG. 7(*a*), the distances L1 and L2 are equal to each other, but are different from the distance L3.

In contrast, in FIG. 7(*b*), the distances L4, L5, and L6 are equal to each other. Thus, in case of FIG. 7(*b*), it is possible to more efficiently move the developer adhering to the cleaning roller 75 to the concaved portions and to collect the developer than in case of FIG. 7(*a*). Thus, it is more preferable that the concaved portions 76 are disposed in a staggered manner.

Next, with reference to FIGS. 8(*a*) and 8(*b*), the following description explains a preferable pitch of the concaved portions 76 in case where the concaved portions 76 are disposed in a staggered manner. Here, a pitch of the concaved portions 76 in a perimeter direction of the cleaning roller 75 is a perimeter-direction pitch Xp. Further, in the figure, each of a circle drawn by a broken line and a circle drawn by a continuous line indicates a position in which the concaved portion 76 of the cleaning roller 75 passes over the pressing roller 32. The circle drawn by a broken line indicates a position in which the concaved portion 76 of the cleaning roller 75 passes over the pressing roller 32 at the first rotation. The circle drawn by a continuous line indicates a position in which the concaved portion 76 of the cleaning roller 75 passes over the pressing roller 32 at the second rotation. Note that, the position at the first rotation may be indicated by the continuous line, and the position at the second rotation may be indicated by the broken line.

As apparent from FIGS. 8(*a*) and 8(*b*), the perimeter-direction pitch Xp of the concaved portions 76 of the cleaning roller 75 is appropriately set, so that the developer is moved to the concaved portions 76 of the cleaning roller 75, thereby collecting the developer. That is, in case of FIG. 8(*a*), the broken-line circle at the first rotation and the continuous-line circle at the second rotation are disposed at substantially the same position, and a pitch of both the circles is Xp. In this case, it is difficult to efficiently move the developer to the concaved portions 76 and to collect the developer. In contrast, FIG. 8(*b*) shows such an ideal condition that a perimeter-direction pitch distance between the broken-line circle and the continuous-line circle that are adjacent to each other is Xp/2. Thus, the continuous-line circle at the second rotation is positioned between two broken-line circles at the first rotation that are adjacent to each other. Thus, the developer is efficiently moved to the concaved portions and is efficiently collected.

Figure 9:
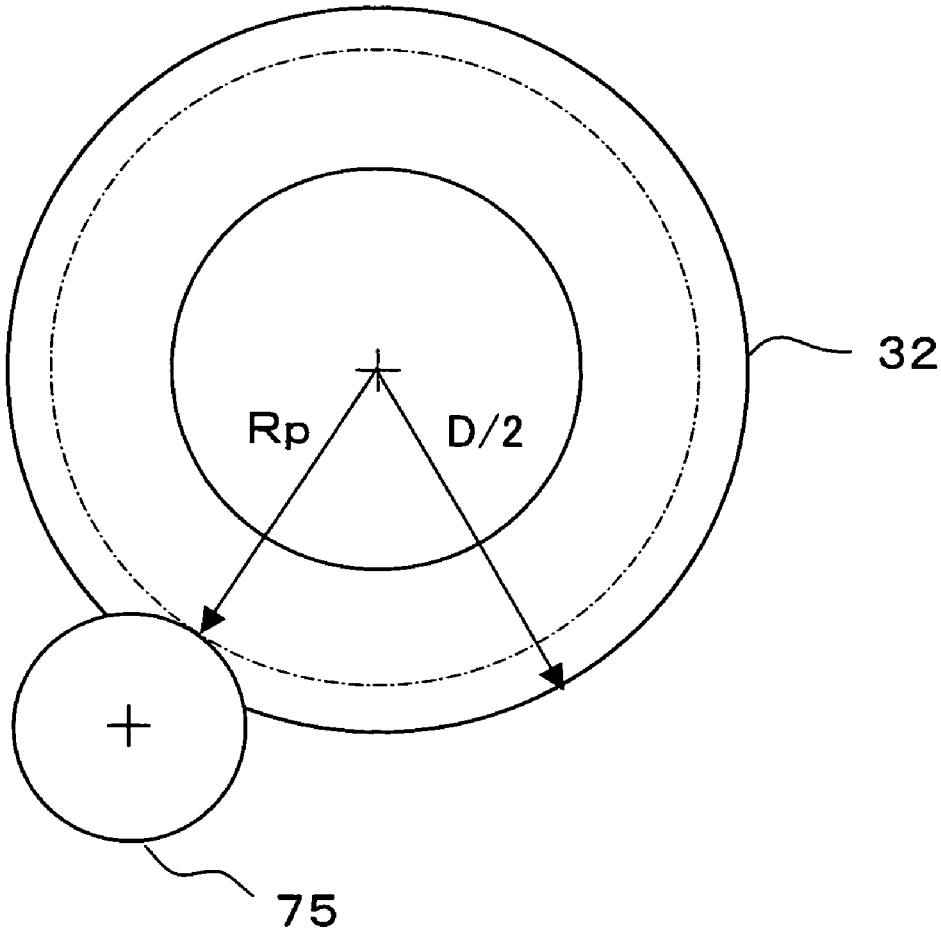
FIG. 9 illustrates an effective radius Rp of the pressing roller shown in FIG. 1.

FIG. 9 shows a condition under which the developer is moved and shows a relationship between the concaved portions 76 of the cleaning roller 75 and the pressing roller 32 in efficiently collecting the unnecessary developer. FIG. 9 shows the effective radius Rp of the pressing roller 32.

In this figure, the concaved portion 76's layout pitch in a perimeter direction of the cleaning roller 75 or the concaved portion 76's layout perimeter-direction pitch in a perimeter direction of the cleaning roller 75 is Xp (mm), and a distance between (i) a maximum depth at which the pressing roller 32 is in contact with the cleaning roller 75 and (ii) a rotational central axis (effective radius) is Rp (mm). At this time, first, it is necessary to satisfy $\pi \cdot Rp/Xp \neq n$ (n is a positive integer). This is based on the following reason.

First, in cleaning the pressing roller 32, the cleaning roller 75 rotates around the effective radius Rp. That is, in case where the cleaning roller 75 makes a round on the pressing roller 32, a distance at which the cleaning roller 75 rotates is $2\pi \cdot Rp$. Further, the perimeter-direction pitch is Xp. Thus, in case where $2\pi \cdot Rp/Xp = n$ (n is a positive integer) is satisfied, the concaved portion 76 of the cleaning roller 75 passes the same position of the pressing roller 32 no matter how many rounds the cleaning roller 75 may make. In this case, the developer cannot be efficiently collected as described above. That is, the concaved portion 76 cannot collect the developer remaining on a position other than the "same position".

Thus, it is necessary to satisfy $2\pi \cdot Rp/Xp \neq n$ (*n* is a positive integer). Note that, $2\pi \cdot Rp/Xp \neq n$ (*n* is a positive integer) and $\pi \cdot Rp/Xp \neq n$ (*n* is a positive integer)

are necessary and sufficient conditions. In case where these expressions are satisfied, the cleaning roller 75 makes several rounds on the surface of the pressing roller 32, so that the developer is moved from the surface of the pressing roller 75, thereby collecting the developer.

Next, the following description explains a preferable relationship between the perimeter-direction pitch Xp of the concaved portion 76 and the effective radius Rp of the pressing roller 32. In case where the perimeter-direction pitch Xp and the effective radius Rp of the pressing roller 32 satisfy $n+1/4 \leqq \pi \cdot Rp/Xp \leqq n+3/4$ (n is a positive integer), it is possible to more favorably move the developer to the concaved portions of the cleaning roller and to collect the developer. This is based on the following reason.

In case where the foregoing expression is satisfied, the concaved portion 76 of the cleaning roller 75 is positioned in a middle point between positions, in which the concaved portions 76 adjacent to each other at the first rotation are in contact with the pressing roller 32, before the cleaning roller 75 makes three rounds, when the cleaning roller 75 rotates around the pressing roller 32. That is, when the cleaning roller 75 makes at least three rounds on the pressing roller 32, it is possible to move the developer remaining on the pressing roller 32 to the concaved portions of the cleaning roller 75, thereby collecting the developer.

Next, the following description explains a preferable relationship between the perimeter-direction pitch Xp of the concaved portions 76 and the effective radius Rp of the pressing roller 32. In case where the perimeter-direction pitch Xp and the effective radius Rp of the pressing roller 32 satisfy a condition under which $\pi \cdot Rp/Xp$ is substantially equal with n+½ (n is a positive integer), the concaved portion 76 which is in contact with the pressing roller 32 at the second rotation passes a central point of the concaved portion 76 which is in contact with the pressing roller 32 at the first rotation, so that it is possible to move the developer remaining on the pressing roller 32 at the second rotation to the concaved portion 76 of the cleaning roller 75, thereby collecting the developer. Note that, in case where $\pi \cdot Rp/Xp = n + 1/2$ (n is a positive integer), it is possible to more efficiently move the developer and to more efficiently collect the developer.

Next, a shape of the concaved portion 76 is described as follows with reference to FIG. 10(*a*) to FIG. 10(*d*). The cleaning roller 75 shown in FIG. 10(*a*) has the concaved portions 76 each of which has been formed in a circular shape. The cleaning roller 75 is brought into contact with the pressing roller 32, for example, upwardly. Each of black portions indicates the concaved portion 76. Note that, in FIG. 10(*a*), the concaved portions 76 may be positioned in white portions.

An axis-direction length of the pressing roller 32 is longer than an axis-direction length of the cleaning roller 75. Thus, the axis-direction length of the pressing roller 32 is longer than a width of a concaved portion area (an area in which the concaved portions 76 are formed) of the cleaning roller 75. Further, the width of the concaved portion area of the cleaning roller 75 is longer than a maximum sheet width. Thus, the axis-direction length of the cleaning roller 75 is longer than the maximum sheet width. Here, the maximum sheet width means a widest sheet usable in the fixing device according to the present invention. Further, it is not necessary that the axis-direction length of the cleaning roller 75 is equal with the length of the concaved portion area of the cleaning roller 75.

In the following description, FIG. 10(*b*) to FIG. 10(*d*) are identical with FIG. 10(*a*) in terms of the relationship among the pressing roller 32, the cleaning roller 75, the concaved portion area of the cleaning roller 75, and the maximum sheet width.

The cleaning roller 75 of FIG. 10(*a*) is different from the cleaning rollers 75 described as follows with reference to FIG. 10(*b*) to FIG. 10(*d*) in that: the former is arranged so that each of the concaved portions 76 is formed in a circular shape and they are separately distributed, but the latter is arranged so that each of the concaved portion 76 is formed in a groove shape and they are connected to each other.

That is, the concaved portions 76 of the cleaning roller 75 are disposed in a spiral manner in FIG. 10(*b*), and the concaved portions 76 of the cleaning roller 75 are disposed in a ring manner in FIG. 10(*c*), and the concaved portions 76 of the cleaning roller 75 are disposed in a spline manner in FIG. 10(*d*). Each of the concaved portions 76 disposed in a groove manner functions in the same manner as in the circular concaved portion 76 of FIG. 10(*a*), thereby collecting the developer into the grooves.

Note that, in case where the concaved portions 76 are formed in a groove manner as described above, it is easy to form the concaved portion 76. Further, gaps between the concaved portions 76 adjacent to each other are made equal with each other, thereby efficiently collecting the developer.

Further, in case where the concaved portions 76 are formed in a spiral manner as shown in FIG. 10(*b*), a slant of the spiral is set so that the developer collected by the concaved portions 76 moves in the axis direction, thereby promoting the discharge of the collected developer from both ends of the cleaning roller 75. As a result, the cleaning effect is further enhanced.

Further, in case where the concaved portions 76 are formed in a spline manner as shown in FIG. 10(*d*), it is possible to mold the cleaning roller 75 by extruding and molding aluminum material, so that this is superior in terms of the productivity.

Here, as a result of an experiment performed under such condition that the fixing device provided with the pressing roller 32 whose diameter is 40 mm and the aluminum cleaning roller 75 having the concaved portions 76 and a diameter of 15 mm is installed onto an image forming device whose process speed is 335 mm/s, it was confirmed that the collection of the developer was improved as shown in Table 1.

TABLE 1

Figure 8A:
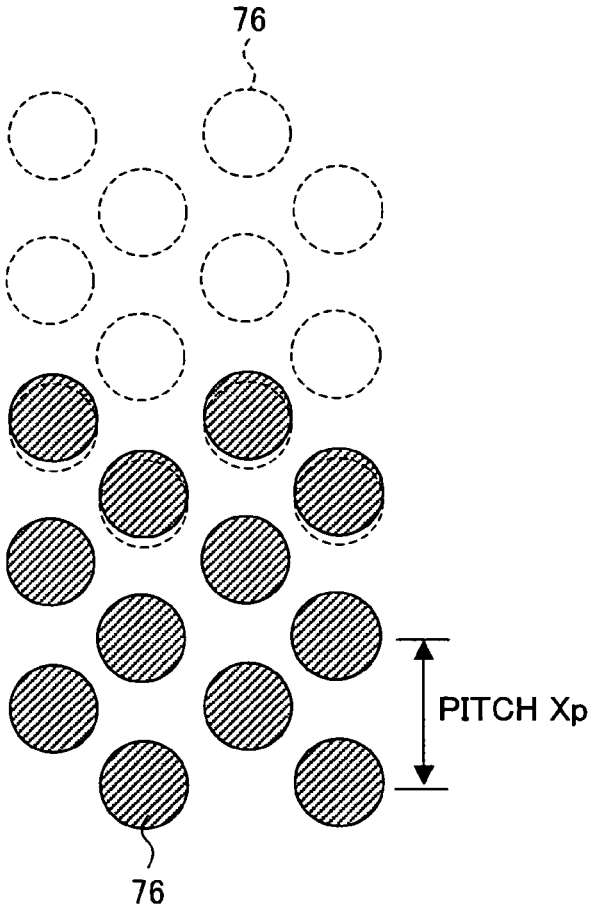
FIG. 8(*a*) illustrates a case where a position (broken line) of the concaved portion at the first rotation of a pressing roller is substantially identical with a position (continuous line) of the concaved portion at the second rotation of the pressing roller when the cleaning roller having the concaved portions of FIG. 6(*b*) is used.
Figure 8B:
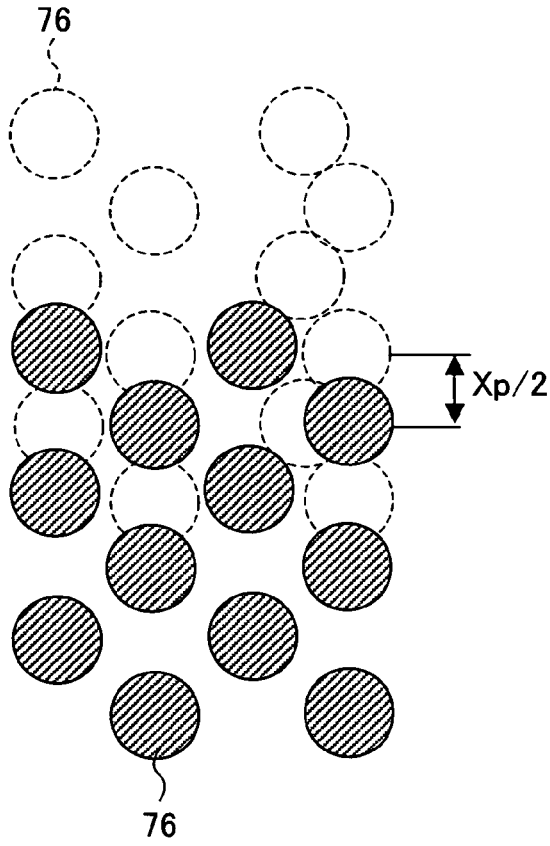
Figure 10A:
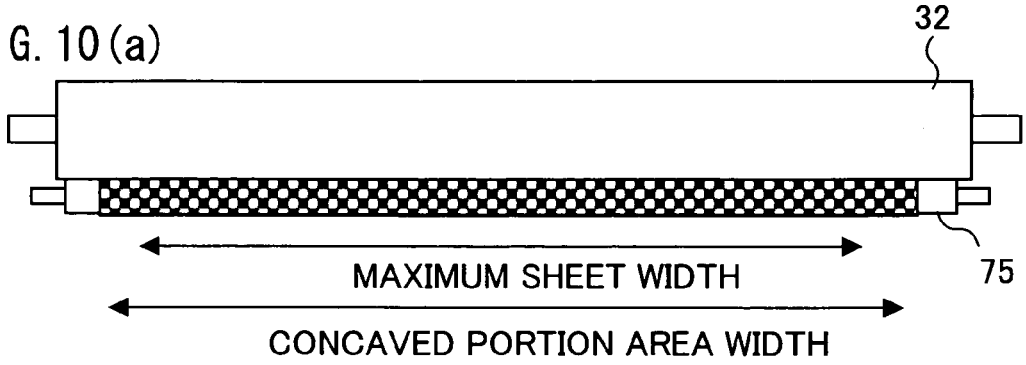
FIG. 10(*a*) illustrates a relationship among a concaved portion area width, a maximum sheet width, and a length of the pressing roller in case where the concaved portions are formed in a staggered manner in the cleaning roller shown in FIG. 1.
Figure 10B:
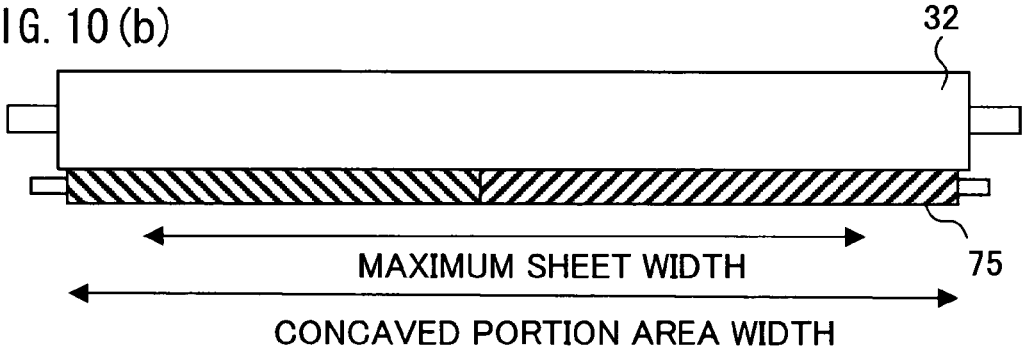
Figure 10C:
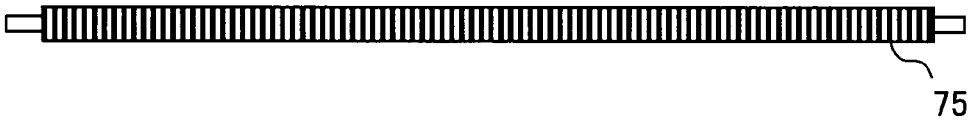
Figure 10D:
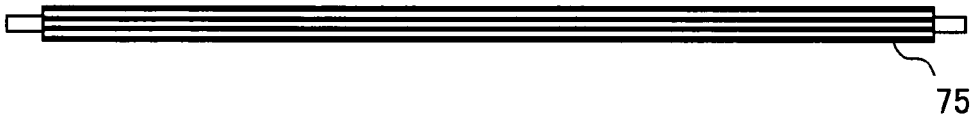

| SHAPE | OPENING WIDTH mm | OPENING DEPTH mm | PITCH mm | DEGREE OF IMPROVEMENT |
|---|---|---|---|---|
| CIRCLE FIG. 8(a) | 2.5 | 1.0 | 7.85* | Δ |
| CIRCLE FIG. 8(b) | 1.0 | 1.0 | 3.14* | ○ |
| RING FIG. 10(c) | 1.0 | 1.0 | 2.0 | Δ |
| SPLINE FIG. 10(d) | 2.0 | 1.1 | 3.0 | ○ |
| SPLINE FIG. 10(d) | 1.3 | 0.76 | 2.0 | ◎ |

*Perimeter-pitch of the concaved portions formed in a staggered manner
A depth at which the pressing roller and the cleaning roller are in contact with each other is 0.5 mm
X: No effect Δ: Effective ○: More effective ◎: Much more effective Table 1 shows that the concaved portions 76 formed in a spline manner are relatively most effective. Further, it was found that: in case where the concaved portions 76 are formed in a spline manner under such condition that an opening width is 1.3 mm and an opening depth is 0.76 and a pitch is 2.0, the concaved portions 76 are more effective.

Figure 11A:
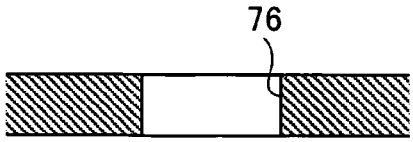
FIG. 11(*a*) is a longitudinal sectional view showing an example of the concaved portion, formed in the cleaning roller shown in FIG. 1, which leads to a space section.
Figure 11B:
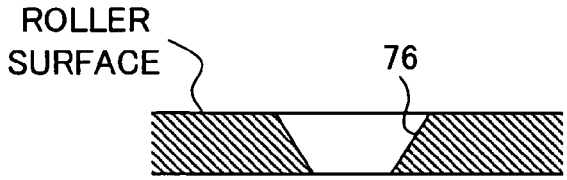

Next, a cross sectional shape of the concaved portion 76 of the cleaning roller 75 is described as follows. Each of FIG. 11(*a*) and FIG. 11(*b*) shows a longitudinal cross sectional shape (cross sectional shape in a depth direction) of the concaved portion. In FIG. 11(*a*), the concaved portion 76 is shaped so as to have a constant width. In contrast, FIG. 11(*b*) shows a condition under which the width of the concaved portion 76 becomes narrower as it comes closer to the rotational axis. As to the longitudinal cross sectional shape of the concaved portion, it is not preferable to shape the concaved portion 76 so as to have a constant width as shown in FIG. 11(*a*), but it is preferable to shape the concaved portion 76 so that its width is narrower as it comes closer to the rotational axis as shown in FIG. 11(*b*).

This is based on the following reason. A capillary pressure based on a surface tension of toner (developer) is inversely proportion to a surface distance when the toner fuses. Thus, the concaved portion is shaped as shown in FIG. 11(*b*), so that a critical pressure on the side of the roller axis becomes greater than a critical pressure based on the capillary phenomenon of the concaved portion 76 that occurs on the side of the surface of the cleaning roller 75, thereby promoting the movement of the fused toner to the side of the axis. As a result, it is possible to improve the cleaning effect.

Figure 12:
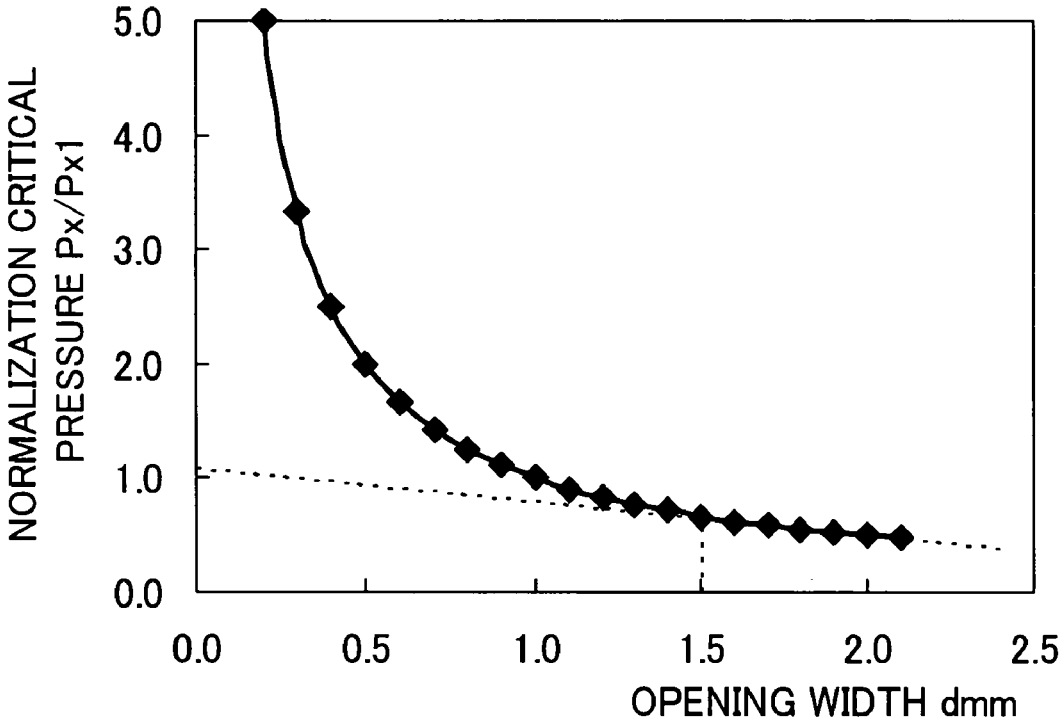
FIG. 12 is a graph showing a relationship between an opening width of the concaved portion formed in the cleaning roller shown in FIG. 1 and a normalization critical pressure of fused toner.

Here, a normalization critical pressure obtained by dividing the critical pressure Px of an arbitrary opening width or an arbitrary groove width by the critical pressure Px1 based on the capillary phenomenon under such condition that the opening width or the groove width is 1 mm is Px/Px1. As shown in FIG. 12, the normalization critical pressure Px/Px1 converges into a single curve without being influenced by the surface tension of the fused toner, and the opening width is set to be not more than 1.5 mm, so that it is possible to largely increase the critical pressure, thereby promoting the collection of the fused toner to the concaved portions 76 due to the surface tension.

Figure 13:
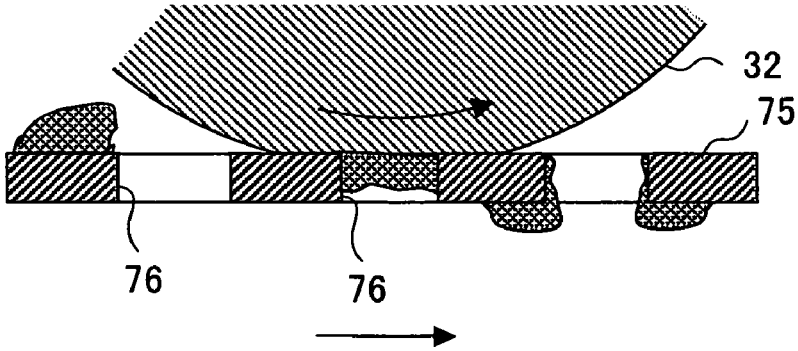
FIG. 13 illustrates how the concaved portion formed in the cleaning roller shown in FIG. 1 collects unnecessary developer.

FIG. 13 is a cross sectional view showing a condition under which the cleaning roller 75 collects the developer remaining on the pressing roller 32. Note that, for convenience in description, FIG. 13 shows a condition under which the cleaning roller 75 is developed into a flat condition. In this case, the axis exists in a direction adverse to a direction of the pressing roller 32. In the arrangement of FIG. 13, the cleaning roller 75 is formed in a hollow manner. Thus, the concaved portions 76 are entirely or partially connected to an internal hollow portion.

According to the foregoing arrangement, the pressing roller 32 and the cleaning roller 75 are brought into contact with each other, so that the developer collected by the concaved portion 76 moves to the hollow portion via the concaved portions 76.

Further, when the cleaning roller 75 is formed in a hollow manner and the concaved portions 76 are entirely or partially connected to the hollow portion, toner adhering to a surface of the cleaning roller 75 can be moved to the hollow portion via the concaved portions due to a contact pressure of the pressing roller 32. Thus, the collected toner does not remain on the concaved portions 76, so that it is possible to stabilize the cleaning effect over an extended period of time.

Further, it is preferable to set a minimum opening width or a minimum groove width of the concaved portion 76 on the surface of the cleaning roller to be larger at least than a diameter of a paper dust fiber which exists on the pressing roller 32. By setting the minimum opening width and the minimum groove width in this manner, it is possible to prevent the rear surface of the sheet from being tainted by the toner particle clot, constituted mainly of paper dusts remaining on the surface of the concaved portion 76, which grows and is exfoliated from the cleaning roller 75.

More preferably, the minimum opening width or the minimum groove width of the concaved portion 76 is set to be not less than five times as large as a maximum value of a longer side of the paper dusts, so that it is possible to surely prevent the paper dusts from being held in a bridge (arch) manner.

Further, the pigment concentration of general toner ranges from 3 to 4%, but it is known that the pigment concentration is raised in order to reduce the consumption of toner. However, when the pigment concentration is raised, viscosity of the fused toner increases, so that efficiency at which the toner remaining on the cleaning roller 75 moves and is collected becomes lower. It is obvious that the viscosity increases from viscosity formula of Einstein which logically clarifies a relationship between a volume ratio and viscosity of dispersoid obtained by dispersing particles in solvent.

The pigment concentration for reducing the toner consumption is at least 7% or more, preferably 10% or more. At this time, the viscosity rises by 2 to not less than 4%, and preferable pigment concentration is 5 to not less than 8%.

In this manner, when a cleaning controller having a concaved portions according to the present invention is adopted in an image forming device fixing section using toner generally hard to remove, it is possible to appropriately collect toner whose viscosity has been raised by making the pigment concentration higher. As a result, it is possible to effectively prevent the rear surface of the sheet from being tainted.

FIG. 14 is a front view showing an internal structure of an electrophotographic image forming device of the present embodiment. Note that, FIG. 14 illustrates only portions concerning the electrophotographic image forming device and does not show all the functions of an actual device.

The image forming device 41 records and outputs an image, read by an image reading device 42 (see FIG. 15), and records and outputs dat*a*, outputted from a device (for example, an image processing device such as a personal computer) connected from the outside to the image forming device 41, as an image.

In the image forming device 41, processing units respectively having functions required in an image forming process are disposed around a photosensitive drum 1, and these processing units constitute an image forming section. Around the photosensitive drum 1, a charging device 2, an optical scanning device 3, a developing device 4, a transcription device 5, a cleaning device 6, an electricity removing device 7, and the like are sequentially disposed in a rotational direction of the photosensitive drum 1.

The charging device 2 evenly charges a surface of the photosensitive drum 1. The optical scanning device 3 writes an electrostatic latent image by scanning a light image on the photosensitive drum 1 that has been evenly charged. The developing device 4 visualizes the electrostatic latent image, written by the optical scanning device 3, with the developer (for example, toner) supplied from a developer supplying container 8. The transcription device 5 transcribes the image, visualized on the photosensitive drum 1, onto a recording material. The cleaning device 6 removes the developer, remaining on the photosensitive drum 1 so that a new image can be formed on the photosensitive drum 1. The electricity removing device 7 removes electric charge from the surface of the photosensitive drum 1.

In a lower portion of the image forming device 41, a supplying tray 9 is provided. The supplying tray 9 is a recording material storage tray for storing the recording materials. The recording materials stored in the supplying tray 9 are separated from each other by a pickup roller 10 or the like, and each of the recording materials is transported to a resist roller 11, and the resist roller 11 adjusts a timing at which an image formed on the photosensitive drum 1 is transcribed onto the recording material, and the recording materials are sequentially supplied to a gap between the transcription device 5 and the photosensitive drum 1. The image recorded and reproduced on the photosensitive drum 1 is transcribed onto the recording material. Note that, the recording materials are replenished by drawing the supplying tray 9 toward a front side (operation side) of the image forming device 41.

Figure 15:
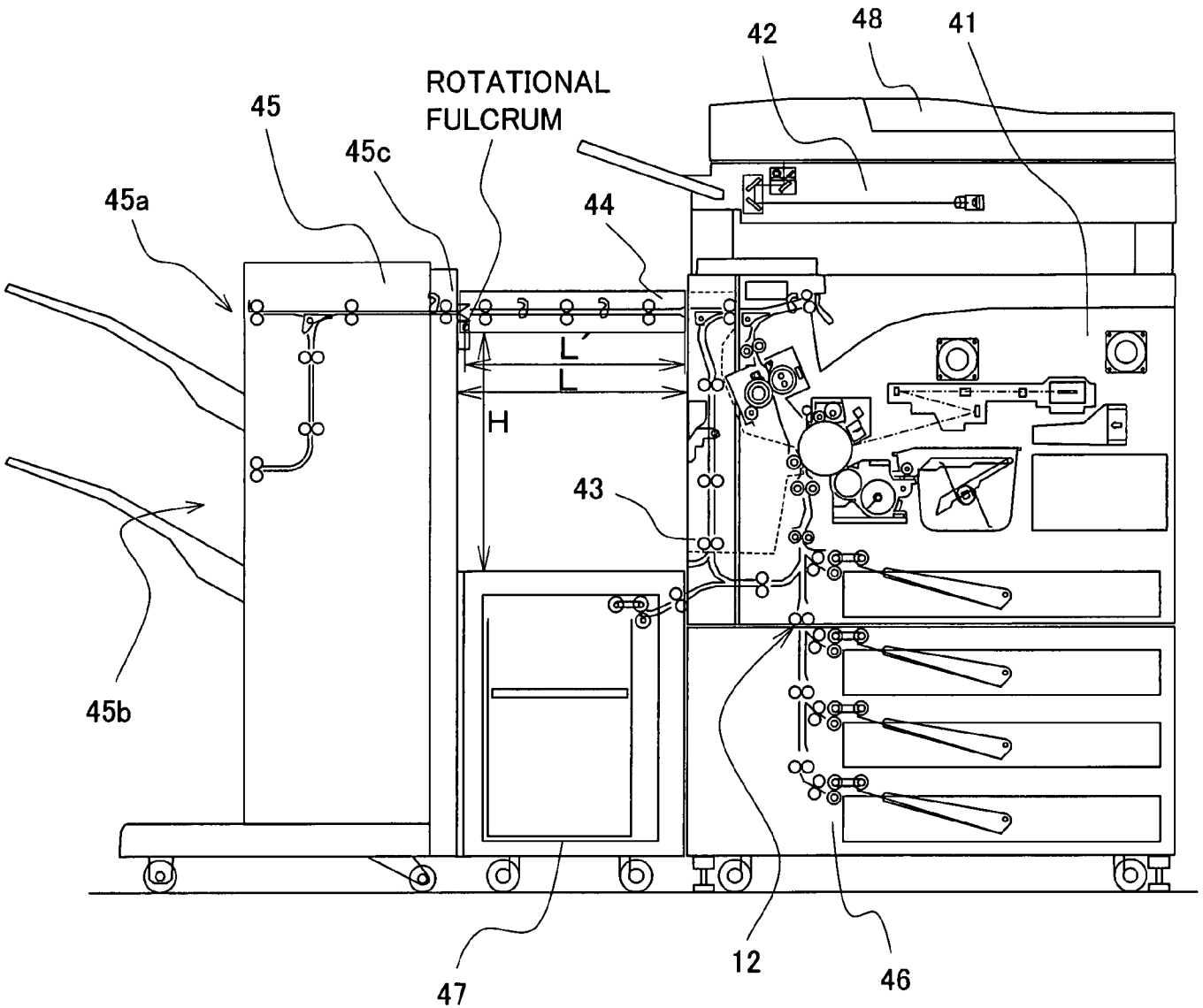
FIG. 15 is a front view showing an internal structure of an image forming system provided with the image forming device shown in FIG. 14.

In a lower portion of the image forming device 41, recording material inlets 12 and 13 are formed. As shown in FIG. 15, the recording material inlets 12 and 13 receive the recording materials transported from (i) a recording material supplying device 46, prepared as a peripheral device, which is provided with a multi-stage recording material supplying tray, (ii) a recording material supplying device 47, which can store a large amount of recording materials, (iii) and the like, so as to sequentially supply the recording materials to the image forming section.

In an upper portion of the image forming device 41, the fixing device 14 is disposed. The fixing device 14 sequentially receives the recording materials on which images have been transcribed, and causes the fixing roller 31 which functions as a fixing member and the pressing roller 32 which functions as a pressing section or a similar member to fix the developed image transcribed on the recording material with heat and a pressure. Thus, an image is recorded on the recording material.

The recording material on which an image has been recorded is transported upwardly by a transport roller 15, and passes through a switching gate 16. Further, in case where a recording material discharging tray is set on a stacking tray 17 externally provided on the image forming device 41, the recording material is discharged to the stacking tray 17 by an reverse roller 18. While, in case where a double-side image formation or a post processing is desired, the recording material is temporarily discharged to the stacking tray 17 by the reverse roller 18. Note that, in this case, the recording material is not completely discharged, and the reverse roller 18 reverses with the recording material held. Further, the recording material is inversely transported in an adverse direction, that is, in a direction in which a recording material re-supplying transport device 43 (see FIG. 15) and a post processing device 45 (see FIG. 15) are selectively provided so as to perform the double-side image formation and the prost processing. At this time, the switching gate 16 switches from a condition indicated by a continuous line of FIG. 14 to a condition indicated by a broken line of FIG. 14.

In case of performing the double-side image formation, the recording material (recording sheet) inversely transported passes through the recording material re-supplying transport device 43, and is supplied to the image forming device 41 again. In case of performing the post processing, the inversely transported recording material is transported from the recording re-supplying transport device 43 via a relay transport device 44 to the post processing device 45 by another switching gate, thereby performing the post processing.

In a space section above the optical scanning device 3, there is disposed a control device 19 for storing a circuit board which controls an image forming process and an interface board or the like which receives image data from an external device. In a space section beneath the optical scanning device 3, there is disposed a power source device 20 for supplying power to the interface board and each of the image formation processing units.

The image forming device 41 shown in FIG. 14 is provided on the image forming system of FIG. 15. The image forming system includes not only the image forming device 41 but also an image reading device 42, the recording material re-supplying transport device 43, the relay transport device 44, the post processing device 45, the recording material supplying device 46, and the recording material supplying device 47.

The image reading device 42 exposes and scans an image of a document, that has been placed thereon, so as to visualize the image on a CCD which is a photoelectric transfer element, and converts the document image into an electronic signal, so as to output thus converted electronic signal as image data. The image data that has been read is subjected to a process such as image correction and rasterize by means of the image processing device of the image forming device 41, and then is written on the photosensitive drum 1 by means of the optical scanning device 3.

The image reading device 42 can read not only a single side but also both sides of a document substantially at the same time, and can automatically (automatic document transport device 48)/manually transport the document.

The recording material re-supplying transport device 43 is a recording material transport path unit provided on a left side surface of the image forming device 41. The recording material re-supplying transport device 43 reverses and transports the recording material, discharged from the fixing device 14, on which an image has been formed, by using the reverse roller 18 of a sheet discharging section provided on an upper portion of the image forming device 41, and supplies the recording material toward a gap (transcription section) between the photosensitive drum 1 and the transcription device 5 again after reversing the recording material.

The relay transport device 44 transports the recording material to the post processing device 45, and is provided between the recording material re-supplying transport device 43 and the post processing device 45.

The post processing device 45 is disposed on a left side of the image forming system, and is provided with a first recording material discharge section 45*a* and a second recording material discharge section 45*b*.

The first recording material discharge section 45*a* causes a receiving transport section 45*c* provided on a side upper portion of the post processing device 45 to receive the recording material, discharged from the image forming device 41, on which an image has been formed, and discharges the recording material as it is.

The second recording material discharge section 45*b* discharges the recording material that has been subjected to a post process performed by the selectively provided post processing device 45 such as a staple, punch, and the like. Either the first and second recording material discharge sections 45*a* or 45*b* is selected by the user as required.

Although not shown, the post processing device 45 is provided with any combination of some of (i) a function for stapling a predetermined number of recording materials, (ii) a function for folding recording materials such as B4-size recording materials or A3-size recording materials, (iii) a function for forming holes which allow the recording materials to be filed, and (iv) a function, realized by a large number of (several to dozens) recording material discharge sections, which sorts or divides the recording materials.

Embodiment 2

The following description will explain another embodiment of the present invention with reference to attached drawings. Note that, a basic internal structure of an electrophotographic image forming device of the present embodiment can be arranged in the same manner as in the structure explained with reference to FIG. 14 and FIG. 15 of Embodiment 1 except for a fixing device. Thus, detail description of the electrophotographic image forming device is omitted here.

Embodiment 2 will explain a case where the present invention is applied to a fixing device provided with a cleaning device using a scraper-shaped member as the cleaning member. First, a structure of the fixing device is detailed with reference to FIG. 16.

Figure 16:
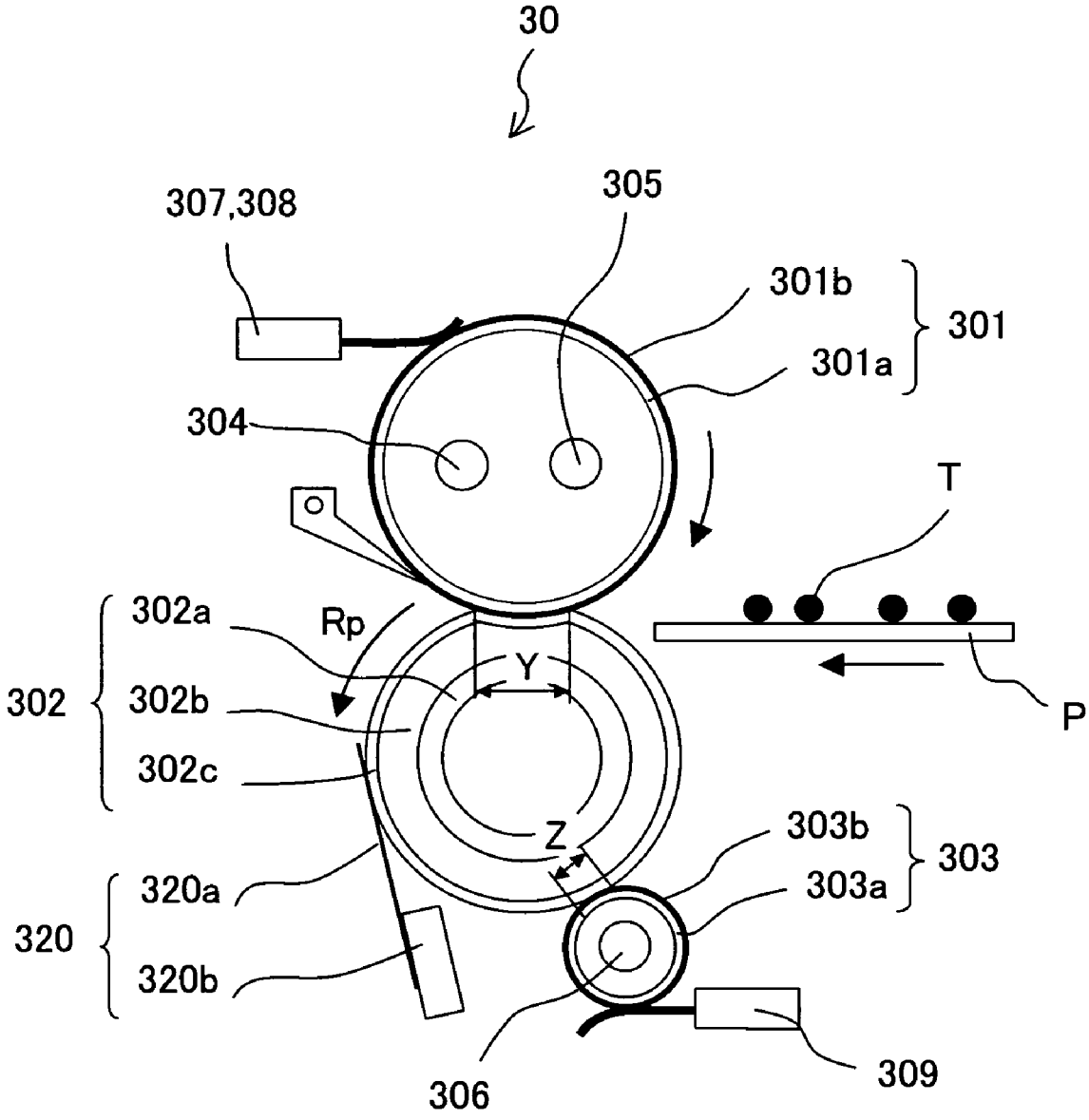
FIG. 16 is a longitudinal sectional view schematically showing a fixing device of another embodiment of the present invention.

The fixing device 30 of FIG. 16 includes: a fixing roller (heating roller) 301 which functions as an upper heating member; a pressing roller 302 which functions as a lower heating member; an external heating roller 303 which functions as an external heating member; heater lamps 304 to 306 which are heat sources for the fixing roller and the external heating roller; temperature sensors 307 to 309 which constitute temperature detection means for detecting temperatures of the fixing roller 301 and the external heating roller 303; a cleaning device 320; and a control circuit (not shown) which functions as temperature controlling means.

Each of the heater lamps 304 to 306 is constituted of a halogen heater, and they are respectively disposed in the fixing roller 301 and the external heating roller 303. The control circuit turns on the heater lamps 304 to 306, so that the heater lamps 304 to 306 emit light at a predetermined thermal distribution. Then, infrared rays are emitted, so that internal surfaces of the fixing roller 301 and the external heating roller 303 are heated.

The fixing roller 301 is heated to a predetermined temperature (here, 200° C.) by means of the heater lamps 304 and 305, and heats a recording paper P on which an unfixed toner image T passing a fixing nip section of the fixing device has been formed. The fixing roller 301 includes: a plug 301*a* which functions as a main body thereof; and a releasing layer 301*b* formed on an peripheral surface of the plug 301*a* so as to prevent the toner T on the recording paper P from being offset.

The plug 301*a* is constituted of, for example, metals such as iron, stainless steel, aluminum, and copper, or alloy thereof. Note that, an iron (STKM) plug whose thickness is 1.3 mm is used as the plug 301*a* of the present embodiment in order to reduce a photoelectric transfer with a diameter of 40 mm.

As the releasing layer 301*b*, fluorine resin such as PFA (copolymer of tetrafluoroethylene and perfluoroalkylvinylether), PTFE (polytetrafluoroethylene), and the like; silicone rubber; fluorine rubber; and the like are suitable. Note that, in the present embodiment, PFA and PTFE are blended with each other, and the resultant is applied so as to have a thickness of 25 μm, and is sintered, thereby obtaining the releasing layer 301*b*.

The pressing roller 302 is arranged so that a heat resistance elastic member 302*b* such as silicone rubber is formed on a peripheral surface of the plug 302*a* constituted of iron, stainless steel, aluminum, and the like. A releasing layer 302*c* constituted of fluorine resin as in the fixing roller 301 may be formed on a surface of the heat resistance elastic layer 302*b* of the pressing roller 302. Note that, the pressing roller 302 of the present embodiment is arranged so that: the heat resistance elastic layer 302*b* made of silicone rubber (rubber hardness is JIS-A 50°) whose thickness is 6 mm is provided on the stainless plug 302*a* whose diameter is 40 mm, and the releasing layer 302*c* made of PFA tube whose thickness is 50 μm is provided on a surface of the heat resistance elastic layer 302*b*, and the pressing roller 302 is pressed against the fixing roller 301 at 76 kgf (745N) by means of a pressing member such as a spring or the like (not shown). Thus, a fixing nip section Y whose width is approximately 6 mm is formed between the fixing roller 301 and the pressing roller 302.

Note that, it is more preferable to use a conductive PFA tube containing conductive agent such as carbon as the PFA tube used in the releasing layer 302*c* of the pressing roller 302. This is based on the following reason. Impurities such as conductive agent are added, so that it is possible to slightly reduce the PFA tube's releasing property with respect to the toner compared with the releasing property of the releasing layer 301*b* of the fixing roller 301. As a result, toner and paper dusts adhering to the fixing roller 301 tends to be moved to the side of the pressing roller 302, thereby obtaining a cleaning effect with respect to the fixing roller 301.

Further, in case where an insulating PFA tube is used as the releasing layer 302*c*, friction between the recording paper and the fixing roller 301 causes the pressing roller 302 to be charged with −5 kV, so that an electric field which repels toner having negative polarity toward the fixing roller 301 acts in the fixing nip section, which causes electrostatic offset (phenomenon in which toner adheres to the fixing roller in an electrostatic manner) with respect to the fixing roller 301. Then, in the present embodiment, the conductive PFA tube is used as the releasing layer 302*c* so as to prevent the pressing roller 302 from being charged, thereby suppressing the electrostatic offset. Note that, in order to obtain an effect for preventing the charging, a PFA tube whose volume resistance is $10^5$ Ωcm is used in the present embodiment.

The external heating roller 303 has a diameter of 15 mm, and has the heater lamp 306 which functions as an internal heating source, and is provided on the upstream side with respect to the fixing nip section so that the external heating roller 303 is pressed against the pressing roller 302 at a predetermined pressure. Further, a heating nip section Z is formed between the external heating roller 303 and the pressing roller 302. The external heating roller 303 is arranged so that a heat resistance releasing layer 303*b* is formed on a hollow-cylindrical metallic plug 303*a* made of aluminum, iron material, and the like. The heat resistance releasing layer 303*b* is constituted of synthetic resin materials superior in the heat resistance property and the releasing property, for example, elastomer such as silicone rubber, fluorine rubber, and the like; or fluorine resin such as PFA, PTFE, and the like. Note that, in the present embodiment, PFA and PTFE are blended with each other, and the resultant is applied so as to have a thickness of 25 μm, and is sintered, thereby obtaining the heat resistance releasing layer 303*b*.

On a peripheral surface of the fixing roller 301, thermistors 307 and 308 are provided as temperature detection means. On a peripheral surface of the external heating roller 303, a thermistor 309 is provided as temperature detection means. Each of the thermistors 307 to 309 detects a surface temperature of each roller. Further, temperature controlling means (not shown) controls a condition, under which the heater lamps 304 to 306 are turned ON/OFF so that a temperature of each roller is a predetermined temperature, in accordance with temperature data detected by each thermistor.

Further, a recording paper on which an unfixed toner image has been formed is transported to the fixing nip section at a predetermined fixing speed and a predetermined copying speed, and the toner image is fixed with heat and a pressure.

Next, the cleaning device 320 according to the present embodiment is detailed as follows with reference to FIG. 16 to FIG. 18.

The cleaning device 320 removes foreign substances D, adhering to the pressing roller 302, such as toner, paper dusts, and the like, so as to clear taints of the pressing roller 302, and is arranged so that a cleaning member 320*a* constituted of a flat scraper (blade) is provided on a holder 320*b*. Further, the cleaning device 320 is disposed in a vicinity of the upstream side with respect to the external heating roller 303.

As the cleaning member 320*a*, it is possible to use a heat resistance resin sheet such as polyimide, or a metallic thin plate made of stainless, phosphor bronze, and the like, or a material obtained by coating any one of these materials with fluorine as required. In the present embodiment, a stainless material whose thickness is 0.1 mm is used.

Figure 17:
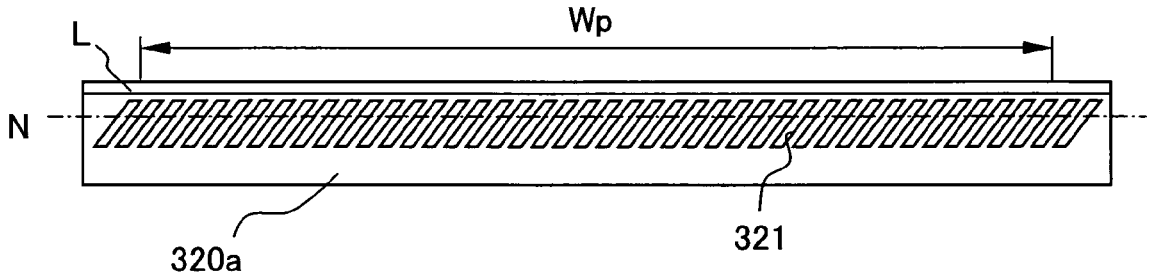
FIG. 17 is a plan view showing an example of an arrangement of a cleaning member used in the fixing device shown in FIG. 16.
Figure 18:
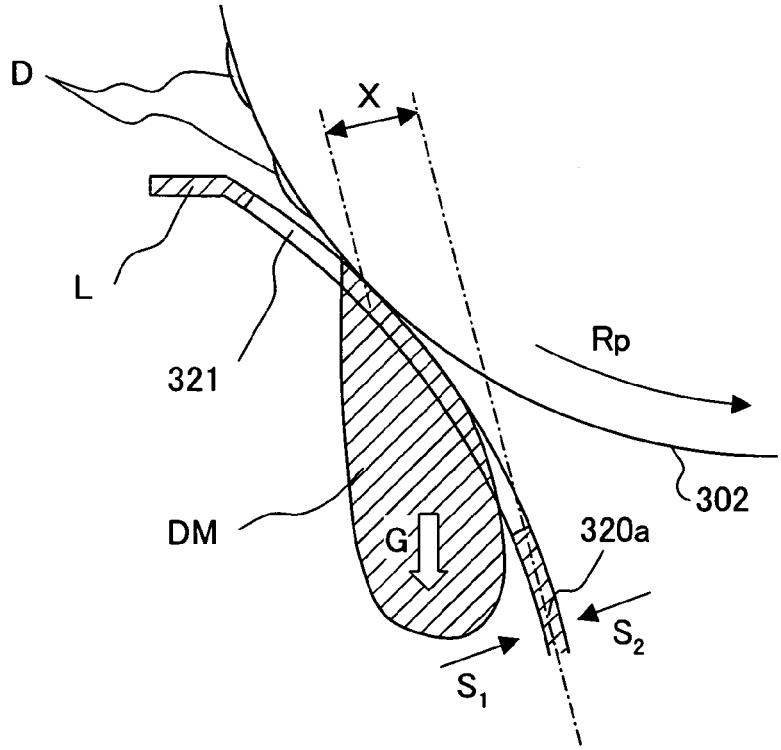
FIG. 18 illustrates how the cleaning member shown in FIG. 17 collects unnecessary developer.

As shown in FIG. 17, the cleaning member 320*a* is arranged so that: a plurality of parallelogram opening sections 321 are provided on an area slightly larger than the maximum paper passing width Wp of the recording paper P by performing an etching process or the like. Each of the opening sections 321 is formed so that its longer side slants with respect to a rotational direction (perimeter direction) of the pressing roller 302. Further, in FIG. 17, "N" indicates a position in which the scraper 503 and the pressing roller 502 are brought into contact with each other. Further, as shown in FIG. 18, an end portion L of the cleaning member 320*a* is bent toward a face S1 which is a rear face with respect to a face S2 being in contact with the pressing roller 302.

The cleaning member 320*a* is held by a holder 320*b* so that the end portion L is positioned in a counter direction with respect to a rotational direction (arrow Rp) of the pressing roller 302 and the contact point N to the pressing roller 302 exists in the opening section H. Further, a bending amount X in the contact point N is set to be 1.1 mm. Further, the cleaning member 320*a* is held by the holder 320*b* so that the face S2 via which the cleaning member 320*a* is in contact with the pressing roller 302 is positioned in an upper side and the face S1 which is not in contact with the pressing roller 302 is positioned in a lower side.

In the fixing device 30 according to the present embodiment, the cleaning device 320 is arranged in the foregoing manner, so that it is possible to obtain the following effects unlike a conventional technique (see FIG. 25 and FIG. 27) in which toner is scraped with an edge portion of a scraper.

First, the parallelogram opening sections 321 formed on the cleaning member 320*a* are brought into contact with the pressing roller 302. Thus, even when there is unevenness in terms of a degree to which the cleaning member 320*a* sticks out, any part of an edge portion of the slanting line constituting the opening section 321 is surely in contact with a surface of the pressing roller 302. As a result, the cleaning member 320*a* can stably bring the edge portion of the slanting line constituting the opening section 321 into contact with the surface of the pressing roller 302 regardless of lot unevenness and thermal deformation (thermal expansion) of the cleaning member.

Secondly, the cleaning member 320*a* includes the opening section 321, so that the cleaning member is less likely to spring than a conventional cleaning member having no opening section. As a result, the cleaning member 320*a* can be brought into contact with the pressing roller 302 at a lower pressure than that of the conventional one, so that a load exerted to the pressing roller 302 is reduced, thereby extending a life of the pressing roller 302.

Thirdly, not the edge but the surface of the cleaning member 320*a* is in contact with the pressing roller 302, so that this arrangement does not raise such a conventional problem that the edge of the scraper breaks so deeply into the pressing roller that the pressing roller is damaged.

Fourthly, even when the cleaning member 320*a* thermally expands, deformation caused by the thermal expansion is absorbed by the opening sections 321, so that the cleaning member is not swung by heat unlike the conventional one, thereby stably and entirely bringing the cleaning member 320*a* into contact with the surface of the pressing roller 302.

Figure 28:
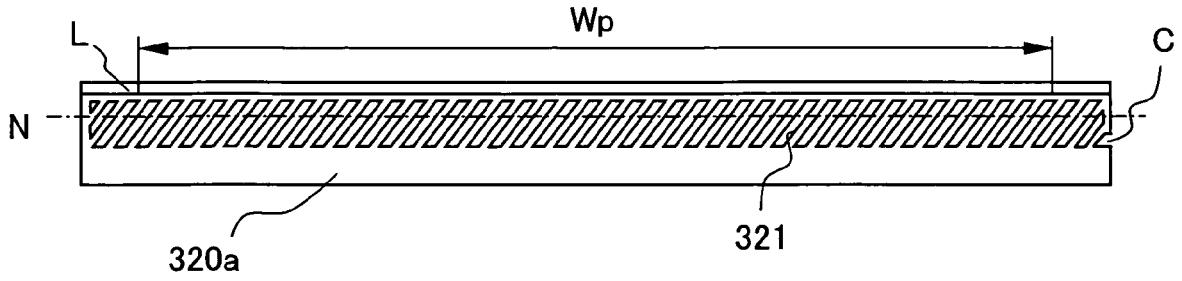
FIG. 28 is a plan view showing an example of an arrangement of a cleaning member used in the fixing device shown in FIG. 16.

Particularly, in case where a notch portion C is formed on a part of an outer edge (frame) of a blade portion entirely surrounding the plurality of opening sections 321 like the cleaning member 320*a* shown in FIG. 28, even when the frame thermally expands, the thermal expansion can be absorbed by the notch portion C, so that it is possible to prevent the cleaning member from being floated and swung by the thermal expansion of the frame.

Fifthly, the foreign substances D scraped by the cleaning member 320*a* move to the face S1 positioned on the front side of the cleaning member 320*a* via the opening sections 321, and toner puddle DM is formed thereon. As a result, unlike the conventional technique, no foreign substance D is deposited on a gap between the face S2 positioned on the rear side of the cleaning member and the pressing roller, so that it is possible to prevent the deposited foreign substances from adhering (flowing) to the pressing roller.

Particularly, in case where a large number of parallelogram opening sections are formed as the opening sections 321 like the present embodiment, it is possible to arrange the cleaning member 320*a* so that a slanting edge portion of the opening section 321 surely exists in the sheet passing area Wp (direction in which a sheet passes) while securing strength of the cleaning member 320*a*.

Figure 29:
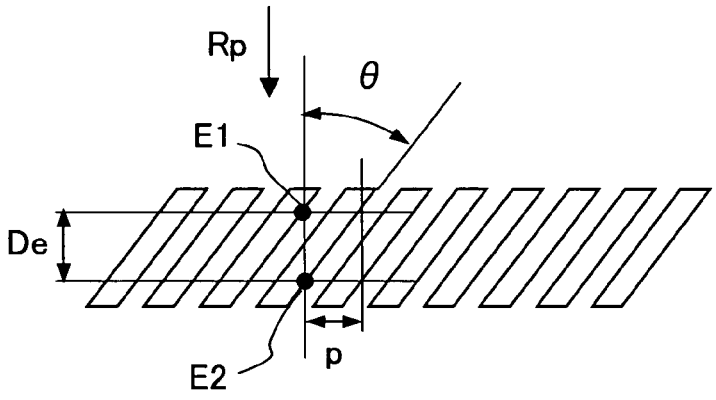
FIG. 29 illustrates a shape of an opening of the cleaning member shown in FIG. 17 or FIG. 28.

In this case, when an angle at which the opening section 321 slants with respect to a moving direction Rp of the pressing roller surface to be cleaned is θ and a pitch of the opening sections 321 is p as shown in FIG. 29, a distance De between edges E1 and E2 of the opening sections which exist in the same line in the moving direction Rp of the pressing roller surface is expressed as follows.

$$De = p/\tan\theta$$

Thus, when the angle and the pitch of the opening sections are set so that the distance De between the edges E1 and E2 of the opening sections is smaller than a width at which the cleaning member and the pressing roller are in contact with each other, that is, so as to satisfy $p/\tan\theta \leqq Wn$, it is possible to bring at least two edges in contact with the surface of the pressing roller in the moving direction of the pressing roller surface. As a result, it is possible to further enhance such an effect that the cleaning member 320*a* scrapes foreign substances (cleaning effect).

Further, in case where the cleaning member 320*a* is held so that the face S2 via which the cleaning member 320*a* is in contact with the pressing roller 302 is positioned in an upper side and the face S1 which is not in contact with the pressing roller 302 is positioned in a lower side like the present embodiment, a gravity G causes the foreign substances D, scraped by the edges of the opening section of the cleaning member 320*a*, to fall from the contact face S2 to the non-contact face S1, so that the foreign substances D are more likely to move toward the non-contact face S1 via the opening sections 321.

Sixthly, the surface of the cleaning member 320*a* is in contact with the pressing roller 302, and its end portion L is bent in a direction away from the surface of the pressing roller 302, so that the arrangement does not raise such a conventional problem that toner puddle is formed on an end portion of the cleaning member and flow of the toner puddle taints the recording paper.

Seventhly, the cleaning device 320 and the external heating roller 303 are positioned close to each other (in the present embodiment, a distance between the external heating roller and the cleaning holder is approximately 6 mm), so that heat (heat conduction caused by radiation or convection) emitted from the external heating roller 303 secondarily heats the cleaning member 320*a*. In this case, temperature of the cleaning member 320*a* is kept high compared with a fixing device having no external heating means such as the external heating roller 303 or the like. As a result, it is possible to prevent the fixed toner from clogging the opening sections 321, so that it is possible to stably exhibit the cleaning effect with time.

Here, a result (Experimental Example 1) obtained by studying the cleaning effect and the durability of the pressing roller through a running experiment using the fixing device of the present embodiment is described as follows with reference to Table 2.

The experiment was performed as follows: recording papers (letter-size hammer-milled paper), each of which had a toner image T based on a letter document whose printing ratio was 4%, were sequentially subjected to the fixing process for each 100 papers, and the fixing process was repeated so as to process 300,000 papers, thereby carrying out the running experiment. Further, the first paper of 100 papers was sampled so as to confirm whether the first paper was tainted with toner or not.

Further, whether the PFA tube which functioned as the surface releasing layer 302*c* of the pressing roller 302 was torn/broken or not was regularly confirmed.

Figure 25:
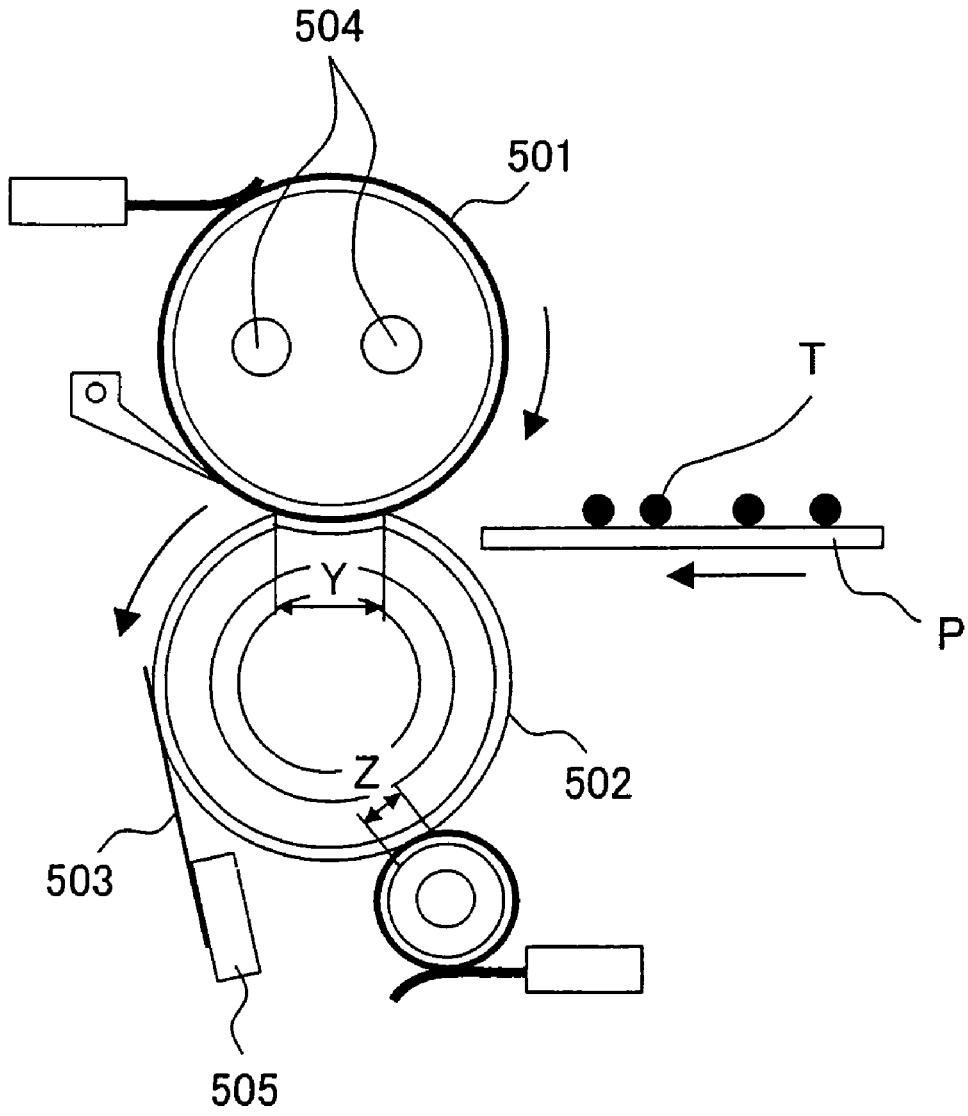
FIG. 25 is a longitudinal sectional view schematically showing a conventional fixing device.
Figure 26:
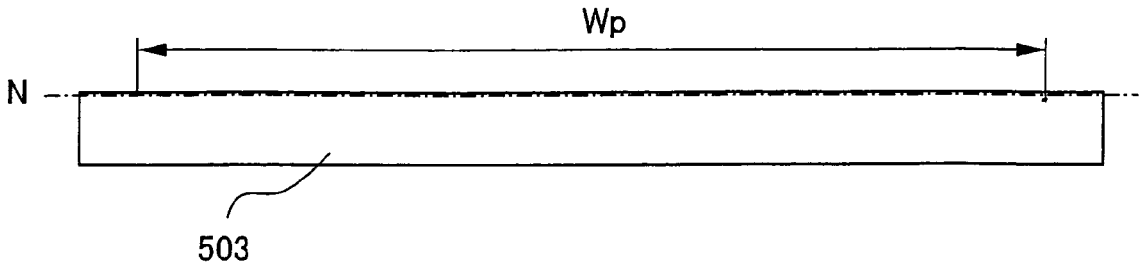
FIG. 26 PRIOR ART
FIG. 26 is a plan view showing an example of an arrangement of a cleaning member used in the conventional fixing device.
Figure 27:
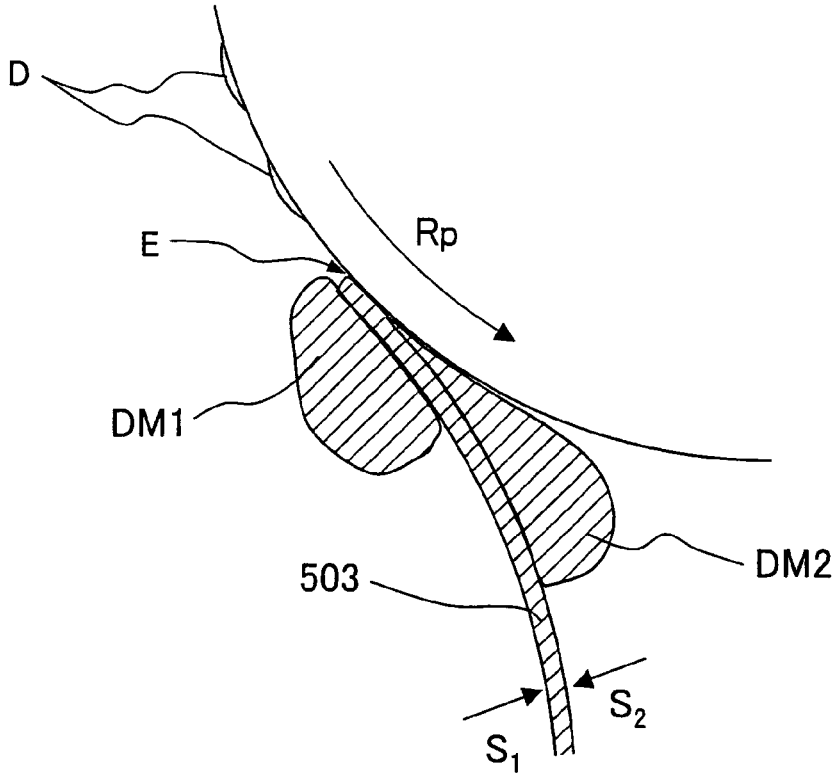
FIG. 27 PRIOR ART
FIG. 27 illustrates how the conventional cleaning member collects unnecessary developer.

Note that, the same experiment was performed also as to the fixing device provided with the cleaning device shown in FIGS. 25 to 27 as a Comparative Example.

TABLE 2

| THE NUMBER OF | EXPERIMENTAL EXAMPLE 1 | | COMPARATIVE EXAMPLE | |
|---|---|---|---|---|
| PAPERS (1000 PAPERS) | TONER TAINT | PRESSING ROLLER | TONER TAINT | PRESSING ROLLER |
| 50 | ○ | ○ | Δ | ○ |
| 100 | ○ | ○ | Δ | ○ |
| 150 | ○ | ○ | x | Δ |
| 200 | ○ | ○ | x | x |
| 250 | ○ | ○ | | |
| 300 | ○ | ○ | | |

[Level of toner taint]
○: Desirable condition (no taint)
Δ: Slightly undesirable (slightly tainted)
x: Undesirable (tainted)
[Condition of the pressing roller]
○: Desirable condition (neither torn nor broken)
Δ: Slightly undesirable (slightly torn or broken)
x: Undesirable (greatly torn or broken)

As shown in Table 2, in the Comparative Example, papers were slightly tainted with toner at an early stage, and 150,000th or further papers were greatly tainted with toner. Further, also as to the pressing roller, a point at which a fold line (fold line made in the production process) of the PFA tube crossed a paper edge cracked at the time when 150,000 papers were processed, and the crack expanded at the time when 200,000 papers were processed, so that the PFA tube was exfoliated. This is because the fold line of the PFA tube is most likely to be damaged by an edge of the cleaning member.

While, in case where the fixing device of the present embodiment was used (Experiment 1), even when 300,000 papers were processed, the papers were not tainted with toner and the pressing roller was not torn or other similar problem did not occur.

Next, as to arrangements of the cleaning device according to the present embodiment and the fixing device provided with the cleaning device, Modification Examples (four examples) different from FIG. 16 is detailed as follows with reference to FIGS. 19 to 21 and FIGS. 30 to 32. Note that, fixing devices 35 to 38 shown in FIG. 19 and FIGS. 30 to 32 are arranged in the same manner as in the fixing device 30 shown in FIG. 16 except for the cleaning device, so that description of the fixing device is omitted.

Figure 19:
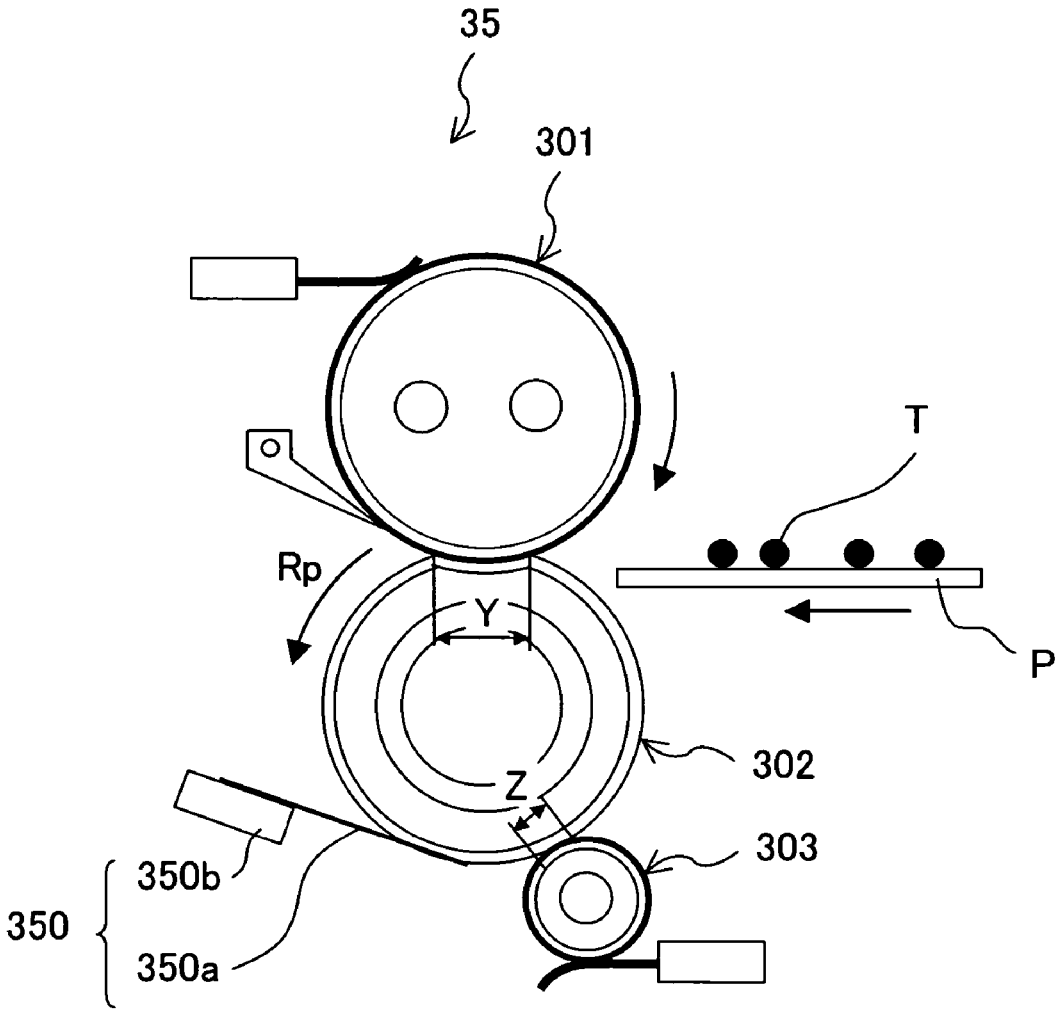
FIG. 19 is a longitudinal sectional view schematically showing a fixing device of still another embodiment of the present invention.

The cleaning device 350 shown in FIG. 19 is arranged so that a cleaning member 350*a* constituted of a flat scraper (blade) is provided on a holder 350*b*, and is disposed in a vicinity of an upstream side with respect to an external heating roller 303. As the cleaning member 350*a*, it is possible to use a heat resistance resin sheet such as polyimide, or a metallic thin plate made of stainless, phosphor bronze, and the like, or a material obtained by coating any one of these materials with fluorine as required. In the present embodiment, a stainless material whose thickness is 0.1 mm is used.

Figure 20:
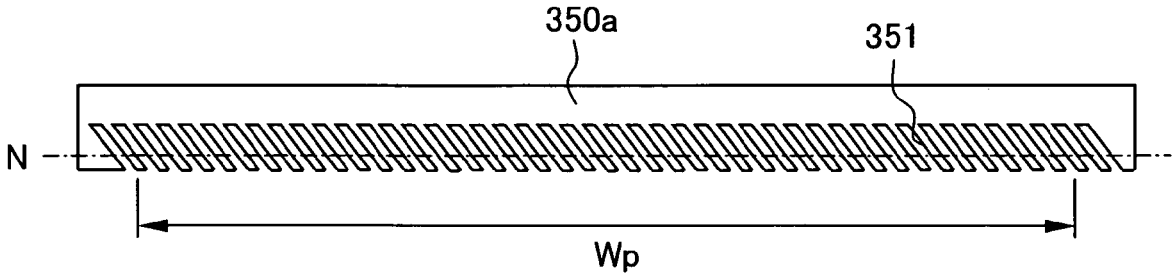
FIG. 20 is a plan view showing an example of an arrangement of a cleaning member used in the fixing device shown in FIG. 19.

Further, an end portion of the cleaning member 350*a* is subjected to an etching process or the like as shown in FIG. 20 so as to have tooth of a serrated portion in an area slightly wider than the maximum paper passing width Wp of the recording paper P, and parallelogram opening sections 351 are parts between the tooth of the serrated portion.

Figure 21:
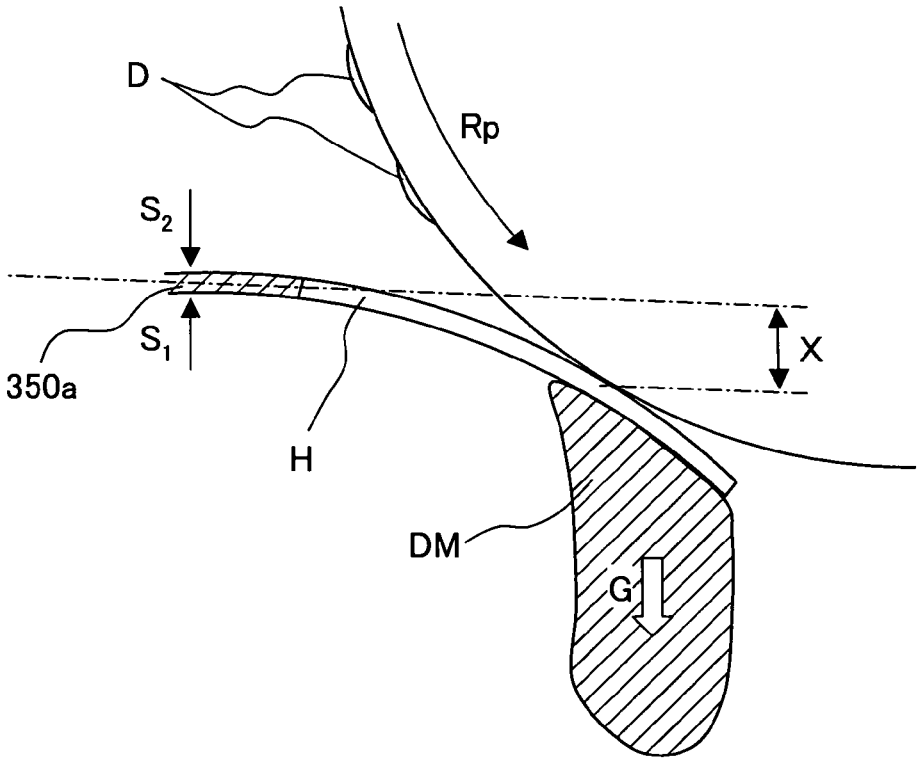
FIG. 21 illustrates how the cleaning member shown in FIG. 20 collects unnecessary developer.

As shown in FIG. 21, the cleaning member 350*a* is held by the holder 350*b* so that the end portion of the cleaning member 350*a* faces in a forward direction with respect to a rotational direction (arrow Rp) of the pressing roller 302 and the opening sections 351 function as a contact point N to the pressing roller 302. Further, a bending amount X in the contact point N is set to be 1.1 mm. Further, the cleaning member 350*a* is held by the holder 350*b* so that the face S2 via which the cleaning member 350*a* is in contact with the pressing roller 302 is positioned in an upper side and the face S1 which is not in contact with the pressing roller 302 is positioned in a lower side.

The cleaning device 350 is arranged as shown in FIG. 19, so that it is possible to obtain the following greater effects than the arrangement of FIG. 16.

Figure 22:
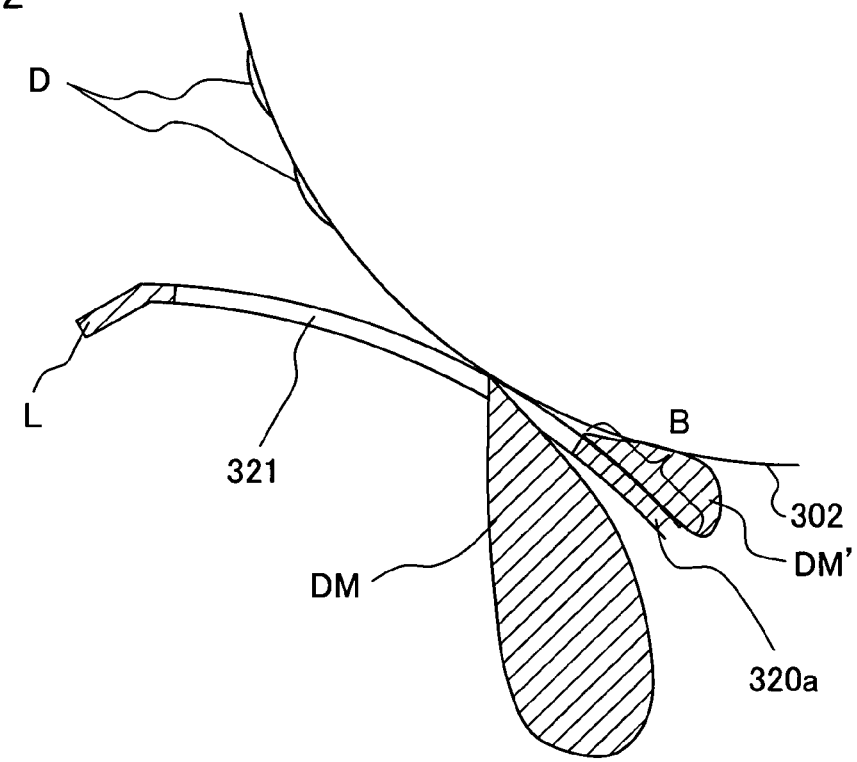
FIG. 22 illustrates an example, different from the example illustrated in FIG. 18, in which the cleaning member shown in FIG. 17 collects unnecessary developer.

First, in case of the arrangement of FIG. 16 in which the end portion of the cleaning member is disposed in a direction adverse to the rotational direction of the pressing roller, as shown in FIG. 22, the cleaning member 320*a* is held by the holder 320*b* so as to be positioned on the downstream side with respect to the contact point between the cleaning member 320*a* and the pressing roller 302, so that a downstream side portion of the cleaning member 320*a* can be less freely designed.

As a result, in case where it is necessary that a portion B positioned on the downstream side with respect to the contact point is placed near the pressing roller 302 as shown in FIG. 22 in terms of the design for example, a toner puddle DM' tends to occur in the portion B. While, in case of disposing the end portion of the cleaning member 350*a* in a forward direction with respect to the rotational direction of the pressing roller 302, this arrangement is free from the foregoing disadvantage, so that it is possible to surely prevent the toner puddle from being formed.

Secondary, when the end portion of the cleaning member 350*a* is divided so as to be a serrated portion as shown in FIG. 19, there is no place on which the toner puddle is formed on the downstream side with respect to the contact point N to the pressing roller 302, so that it is possible to more surely prevent the toner puddle from being formed.

Figure 30:
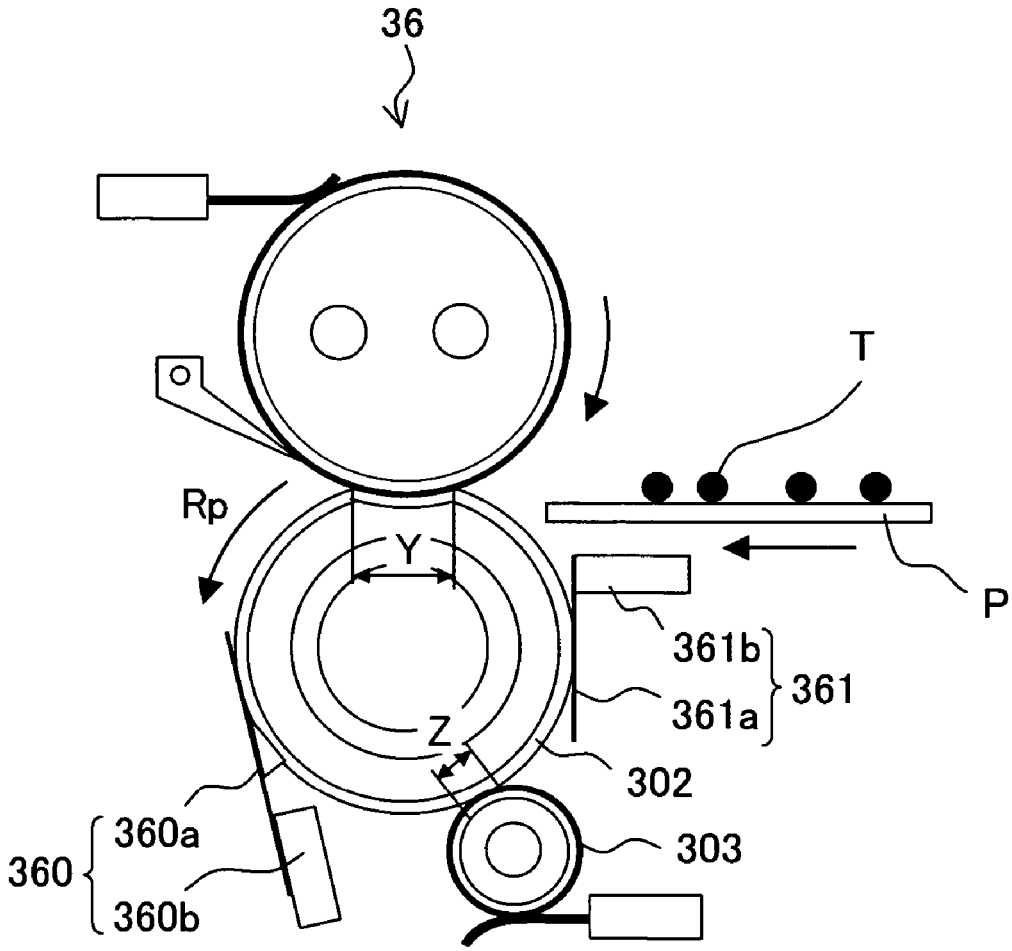
FIG. 30 is a longitudinal sectional view showing a fixing device of further another embodiment of the present invention.

The fixing device 36 shown in FIG. 30 is arranged so that two cleaning devices 360 and 361 are disposed on the upstream side and the downstream side respectively so as to sandwich the external heating roller 303.

The cleaning device 360 is arranged so that the cleaning member 360*a* constituted of a flat scraper (blade) is provided on the holder 360*b*, and the same cleaning device 361 is arranged so that the cleaning member 361*a* constituted of a flat scraper (blade) is provided on the holder 361*b*. As each of the cleaning members 360*a* and 361*a*, it is possible to use a heat resistance resin sheet such as polyimide, or a metallic thin plate made of stainless, phosphor bronze, and the like, or a material obtained by coating any one of these materials with fluorine as required. In the present embodiment, a stainless material whose thickness is 0.1 mm is used.

A plurality of the cleaning devices 360 and 361 are disposed on the fixing device 36 as shown in FIG. 30, so that it is possible to obtain the following greater effects than the arrangement of FIG. 16.

First, it is possible to provide a plurality of points in which foreign substances adhering to the pressing roller 302 are cleared. Even when the foreign substances sneak through the upstream side cleaning device because of partially insufficient cleaning, the foreign substances that have sneaked through the cleaning device are caught by the downstream side cleaning device, so that it is possible to obtain a stable cleaning performance. Of course, when a plurality of conventional scraper-type cleaning devices each of which has no opening section are provided, it is possible to improve the cleaning effect, but a pressure at which the conventional scraper is brought into contact with the pressing roller is high, the plurality of scraper-type cleaning devices give more damage to the pressing roller. While, a pressure at which the scraper having the opening sections of the present invention is brought into contact with the pressing roller is lower than that of the conventional technique, so that the pressing roller is less damaged even when a plurality of cleaning devices are provided.

Secondly, in the cleaning device of the present invention, for example, in case where documents of high printing ratios are sequentially outputted and in case where a large amount of toner adheres also to a non-image area of an image formed by the image forming device because of variation of environmental conditions and the like (generally, this phenomenon is referred to as "fog"), an amount of toner moving (offset) from the recording paper to the fixing roller and the pressing roller increases, and the amount exceeds a limit which allows the toner to be processed via the opening sections of the cleaning member 360*a*, so that a toner puddle DM may be formed on the cleaning member 360*a*.

Further, in case where the fixing device shifts from a halt condition such as a standby mode to a rotation condition again, a portion positioned in the fixing nip section Y on the surface of the pressing roller under the halt condition is locally heated by the fixing roller so that temperature of the portion is high. Thus, the local heating section fuses the toner puddle DM formed on the cleaning member 360*a* in passing through the contact point to the cleaning member 360*a*, so that the fused toner adheres to the pressing roller 232 again, which causes the recording paper to be tainted. However, in the present embodiment, the toner which adheres to the pressing roller 232 again is collected by the downstream side cleaning device 361, so that the recording paper is not tainted.

Further, even in case where an amount of toner offset to the pressing roller is large, most of the toner is cleared by the upstream side cleaning device 360, so that the toner puddle is hardly formed in the downstream side cleaning device 361. Thus, the recording paper is not tainted by the downstream side cleaning device.

Further, even when the toner puddle is formed on the downstream side cleaning device, the local heating section on the surface of the pressing roller is cooled in passing through the cleaning device 360, so that the toner puddle formed on the downstream side cleaning device is not allowed to fuse and flow.

Figure 31:
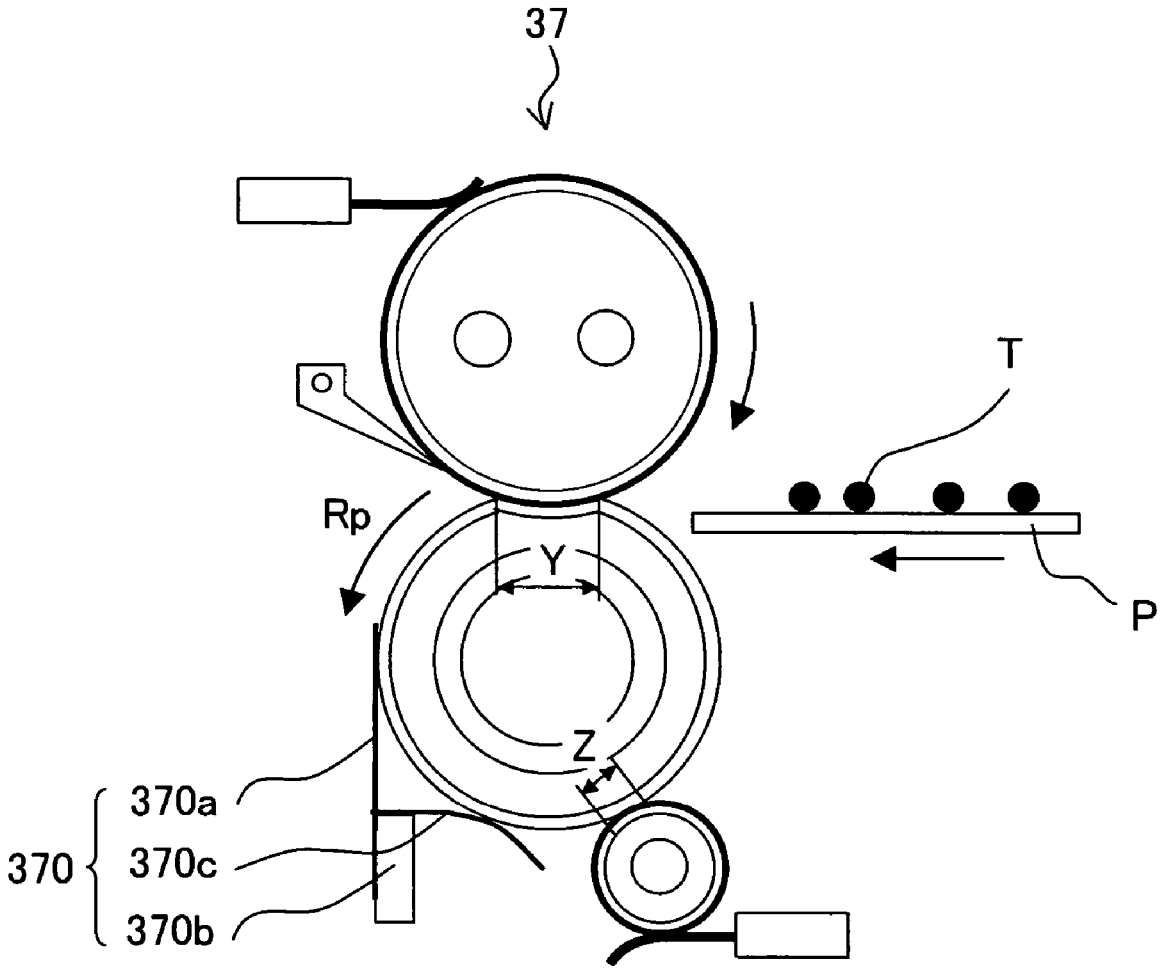
FIG. 31 is a longitudinal sectional view schematically showing a fixing device of still further another embodiment of the present invention.

In the fixing device 37 shown in FIG. 31, the cleaning device 370 is arranged so that the cleaning members 370*a* and 370*c* constituted of two flat scrapers (blades) are provided on the holder 370*b*, and is held so that the cleaning member 370*a* is in contact with the pressing roller in a direction adverse to the rotational direction Rp of the pressing roller and the cleaning member 370*c* is in contact with the pressing roller in a forward direction with respect to the rotational direction Rp of the pressing roller.

In the conventional scraper-type cleaning device, the cleaning member can be provided only in the direction adverse to the rotational direction of the pressing roller, but it is possible to provide the cleaning member both in forward and backward directions in the cleaning device of the present invention, so that it is possible to provide a plurality of cleaning members so freely as shown in FIG. 31. Accordingly, it is possible to miniaturize and simplify the cleaning device 370.

Note that, effects obtained in the arrangement of the fixing device 37 are the same as those obtained in the arrangement of the fixing device 36 shown in FIG. 30.

Figure 32:
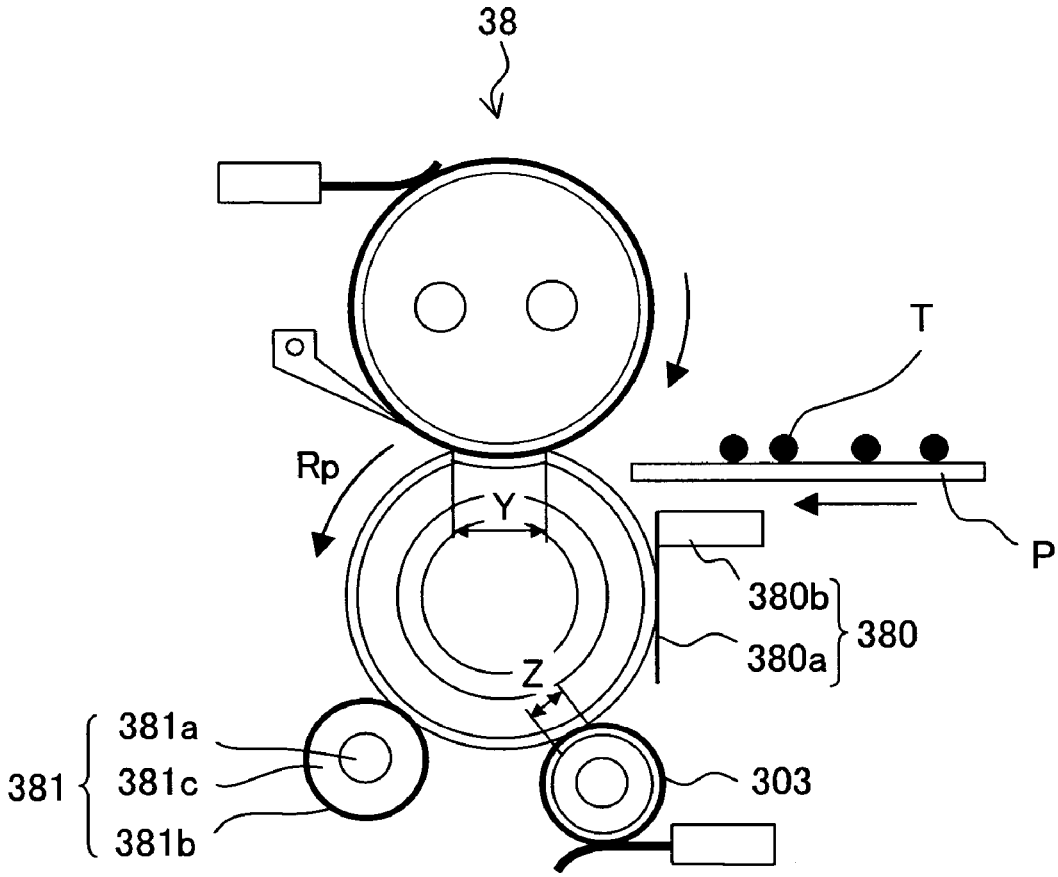
FIG. 32 is a longitudinal sectional view schematically showing a fixing device of still further another embodiment of the present invention.

The fixing device 38 shown in FIG. 32 is arranged so that an oil applying device 381 is provided on the upstream side and a cleaning device 380 is provided on the downstream side so that the external heating roller 303 is sandwiched by the oil applying device 381 and the cleaning device 380.

The oil applying device 381 is formed in a roller shape, and includes: an oil retaining layer 381*b*, provided on a metallic shaft 381*a*, which retains oil as an offset prevention agent; and an oil restriction layer 381*c*, provided on the oil retaining layer 381*b*, which restricts an amount of oil oozed from the oil retaining layer 381*b*.

The oil retaining layer 381*b* may be obtained by injecting silicon oil into a urethane sponge rubber or by kneading silicon oil into silicon solid rubber as required, and viscosity of the silicon oil can be set to be, for example, 100CS to 3000CS or a similar value, depending on a condition under which the image forming device is used (condition such as life, printing speed, and the like).

The oil restriction layer 381*c* may be constituted of a porous fluorine resin (PTFE) film, felt, paper, or the like, and each of these materials can be used as required as long as the material can restrict the amount of oil oozed from the oil retaining layer 381*b*.

Note that, in the present embodiment, 30 g of dimethyl silicon oil whose viscosity is 1000CS is kneaded into the oil retaining layer 381*b* made of solid rubber, and a porous fluorine resin (PTFE) film is provided on a surface of the oil retaining layer 381*b* as the oil restriction layer 381*c*, thereby obtaining an oil applying roller used in the present embodiment.

The cleaning device 380 is arranged so that a cleaning member 380*a* constituted of a flat scraper (blade) is provided on the holder 380*b*. As the cleaning member 380*a*, it is possible to use a heat resistance resin sheet such as polyimide, or a metallic thin plate made of stainless, phosphor bronze, and the like, or a material obtained by coating any one of these materials with fluorine as required. In the present embodiment, a stainless material whose thickness is 0.1 mm is used.

The oil applying device 381 and the cleaning device 380 are provided on the fixing device 38 as shown in FIG. 32, so that it is possible to obtain the following greater effects than the arrangement of FIG. 16.

First, silicon oil applied by the oil applying device 381 reduces an amount of toner moving (offset) from the recording paper to the fixing roller and the pressing roller, so that an amount of toner processed in the cleaning member does not exceed a cleaning capacity of the cleaning member. As a result, formation of the toner puddle is suppressed, thereby obtaining a stable cleaning performance over an extended period of time.

Secondly, silicon oil supplied by the oil applying device 381 adheres also to the cleaning member 380*a*, so that an adhesive force of foreign substances such as toner, paper dusts, and the like, with respect to the cleaning member 380*a* is weakened. As a result, the foreign substances are more likely to move via the opening sections of the cleaning member 380*a*, so that it is possible to prevent the foreign substances from clogging the opening sections, thereby keeping a stable cleaning performance over an extended period of time.

Particularly, even in case where small size sheets are sequentially passed, the silicon oil applied to the non-paper passing area moves to the recording paper, and is deposited on the surface of the pressing roller, so that an amount of silicon oil adhering to the non-paper passing area of the cleaning member 380*a* is larger than that in the paper passing area. Thus, this causes the foreign substances to smoothly move via the opening sections, so that formation of the toner puddle is further suppressed. As a result, it is possible to surely prevent the recording paper from being tainted even in case where small size papers are sequentially passed.

Thirdly, the cleaning device 380 is disposed on the downstream side with respect to the oil applying device 381, so that silicon oil adheres to the cleaning member 380*a* before moving to the recording paper. As a result, the silicon oil adhering to the cleaning member 380*a* further promotes the sneaking of the foreign substances via the opening sections. Further, even when the oil applying device 381 is tainted with toner and paper dusts with time and the foreign substances adhering to the oil applying device 381 moves (flows) to the pressing roller again, the foreign substances are collected by the cleaning member 380 provided on the downstream side, so that the recording paper is not tainted.

Note that, the Embodiments 1 and 2 explained the fixing device (external heating roller type) having the external heating means as the fixing device. However, it is needless to say that: in the fixing device to which the cleaning device of the present invention is applicable, the external heating means is not limited to the external heating roller type, and the cleaning device of the present invention is applicable to a fixing device which requires the cleaning device, for example, (i) a conventional fixing device constituted merely of two rollers (a fixing roller and a pressing roller), (ii) a fixing device using a belt, (iii) and the like.

Further, in the arrangement of the Embodiment 2, the cleaning device of the present invention is applicable not only to the fixing device but also to various kinds of devices each of which uses a scraper-shape (blade-shape) cleaning device as required.

Figure 23:
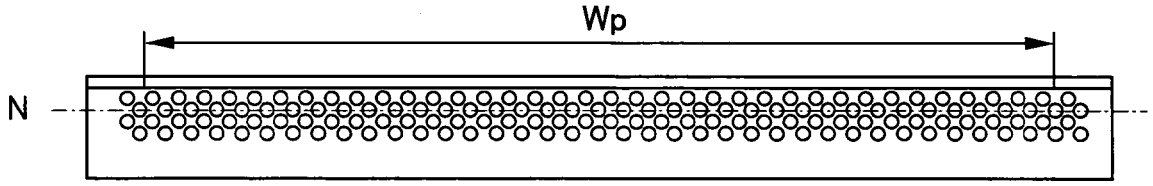
FIG. 23 is a plan view showing another example of an arrangement of the cleaning member used in the fixing device.
Figure 24:
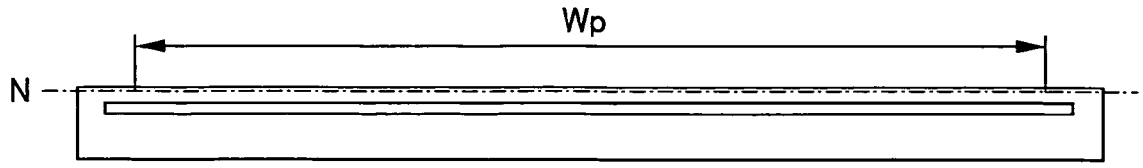
FIG. 24 is a plan view showing another example of an arrangement of the cleaning member used in the fixing device.

Further, in the arrangement of the Embodiment 2, a shape of the opening section of the cleaning member is not limited to the aforementioned parallelogram. As long as the shape realizes the effects described in the present invention, it may be so arranged that: a large number of circular opening sections are provided (see FIG. 23), or a single rectangular opening section is provided (see FIG. 24). Note that, in the arrangement of FIG. 24, it may be so arranged that the end portion edge of the cleaning member is brought into contact with the pressing roller as in the conventional technique.

Further, generally, a pigment concentration of toner ranges from 3 to 4%, and it is known that the pigment concentration is raised in order to reduce toner consumption. However, when the pigment concentration is raised, viscosity of fused toner rises, so that the toner on the cleaning member less efficiently moves and is less efficiently collected. It is apparent that "the viscosity rises" from viscosity formula of Einstein which logically clarifies a relationship between a volume ratio and viscosity of dispersoid obtained by dispersing particles in solvent.

The pigment concentration for reducing the toner consumption is at least 7% or more, preferably 10% or more. At this time, the viscosity rises by 2 to not less than 4%, and preferable pigment concentration is 5 to not less than 8%.

In this manner, when the cleaning member having the opening sections according to the Embodiment 2 is adopted in an image forming device fixing section using toner generally hard to remove, it is possible to appropriately collect toner whose viscosity has been raised by making the pigment concentration higher. As a result, it is possible to effectively prevent the rear surface of the sheet from being tainted.

Further, the fixing device cleaning device of the present invention may be arranged so as to be provided on a fixing device which includes: a heating roller heated by heating means; and a pressing roller pressed against the heating roller at a predetermined contact pressure, a recording sheet being sandwiched by the heating roller and the pressing roller, developer on the recording sheet being fixed, wherein the fixing device cleaning device includes a cleaning roller which is pressed against the pressing roller so as to remove the developer from a surface of the pressing roller, and a plurality of concaved portions are formed on a surface of the cleaning roller.

According to the arrangement, the developer (for example, toner) which adheres from the recording sheet to the heating roller at the time of transcription moves from the heating roller to the pressing roller, and is collected by the cleaning roller (made of metal for example). Here, the fixing device cleaning device is a cleaning device disposed in the fixing device.

Materials for the surface of the heating roller and the surface of the pressing roller are appropriately selected, so that it is possible to move substantially all the developer adhering to the heating roller to the pressing roller. For example, the surface of the heating roller is coated with teflon (registered trademark)(PTFE: polytetra fluoroethylene), and at least a periphery of the pressing roller is made of silicone rubber, so that it is possible to move substantially all the developer adhering to the heating roller to the pressing roller.

Further, the cleaning roller is in contact with the pressing roller, so that unnecessary developer remaining on the surface of the pressing roller is collected by the cleaning roller, and no developer is left on the pressing roller. Thus, it is possible to prevent front and rear surfaces of the recording paper from being tainted.

Note that, temperature of the pressing roller is lower than temperature of the heating roller, and temperature of the cleaning roller is lower than the temperature of the pressing roller. Thus, it is possible to make the temperature of the pressing roller lower than a fusing point of the developer. Thus, the developer remaining on the pressing roller is collected by the cleaning roller with the developer in a non-fusing state, and a pressure at which the pressing roller and the cleaning roller are brought into contact with each other causes the developer to move to the plurality of concaved portions formed on the surface of the cleaning roller, and the developer is collected.

In this manner, the developer is collected by the plurality of concaved portions formed on the surface of the cleaning roller, so that it is possible to collect unnecessary developer more quickly than a conventional arrangement in which the developer is merely discharged from both ends of the cleaning roller in an axis direction for example. Thus, for example, in case where images are sequentially printed on sheets each of which has a large sheet width, or in case where images are sequentially printed on sheets by means of a high speed machine, unnecessary developer is appropriately collected from the heating roller and the pressing roller, so that it is possible to surely prevent front and rear. surfaces of the recording paper from being tainted.

The fixing device cleaning device may be arranged so that the plurality of concaved portions are disposed so as to cover the whole surface of the cleaning roller.

According to the arrangement, it is possible to further improve a function for collecting unnecessary developer from the heating roller and the pressing roller.

The fixing device cleaning device may be arranged so that a cleaning-roller-axis-direction width corresponding to the plurality of concaved portions formed on the cleaning roller is set to be wider than a maximum sheet width processable in the fixing device.

According to the arrangement, in the pressing roller, unnecessary developer is not left on a portion corresponding to the maximum sheet width processable in the fixing device. Thus, even in case of fixing an image on a recording sheet having the maximum sheet width, front and rear surfaces of the recording sheet are not tainted. Note that, the cleaning-roller-axis-direction width means a width of the cleaning roller in an axis direction.

The fixing device cleaning device may be arranged so that the plurality of concaved portions are disposed in a staggered manner. In this case, the concaved portions formed on the surface of the cleaning roller respectively have separate shapes. For example, the shapes include a circular shape, an oval shape, a polygonal shape, or other irregular opening shape.

According to the arrangement, in case where the developer moves in the axis direction of the cleaning roller and is collected by the concaved portions between the fixing roller and the cleaning roller, the concaved portions cover the whole area of the surface of the cleaning roller in its axis direction, so that it is possible to efficiently collect the developer. Further, in the surface of the fixing roller, when an area contacted by the concaved portions of the cleaning roller at the first rotation of the fixing roller deviates from an area contacted by the concaved portions of the cleaning roller at the second rotation of the fixing roller, an area positioned in the fixing roller so as to contact the concaved portions can be highly densified, so that it is possible to further improve the efficiency at which the developer is collected. For example, in case where any one of the foregoing layouts of concaved portions is in ½ pitch, the concaved portion is positioned in a middle point of the concaved portions adjacent to each other, and an area positioned in the fixing roller so as to contact the concaved portions can be highly densified.

The fixing device cleaning device may be arranged so that the plurality of concaved portions are formed in a groove manner so as to extend, on the surface of the cleaning roller, in the axis direction of the cleaning roller.

According to the arrangement, it is easy to form the concaved portions, and the concaved portions adjacent to each other can be equalized, so that it is possible to efficiently collect the developer from the surface of the fixing roller.

The fixing device cleaning device may be arranged so that the plurality of concaved portions are formed in a groove manner so as to go around the surface of the cleaning roller.

According to the arrangement, it is easy to form the concaved portions, and the concaved portions adjacent to each other can be equalized, so that it is possible to efficiently collect the developer from the surface of the fixing roller. Further, in case where the concaved portions are formed in a spiral manner, the developer collected by the concaved portions moves in the axis direction of the cleaning roller, and this induces the developer to be discharged from a roller end portion, so that it is possible to keep the cleaning function over an extended period of time.

The fixing device cleaning device may be arranged so that: $\pi \cdot Rp/Xp \neq n$ (n is a positive integer) where a layout pitch of the concaved portions in a perimeter direction of the cleaning roller is Xp (mm) and a distance between (i) a maximum depth at which the pressing roller is in contact with the cleaning roller and (ii) a rotational central axis of the pressing roller is Rp (mm).

According to the arrangement, in the surface of the pressing roller, a portion contacted by the concaved portion at the second rotation of the pressing roller does not overlap a position contacted by the concaved portion at the first rotation of the pressing roller. Thus, an area positioned in the surface of the pressing roller so as to be contacted by the concaved portions is highly densified, so that it is possible to efficiently collect the developer from the surface of the pressing roller.

The fixing device cleaning device may be arranged so that: $n+1/4 \leqq \pi \cdot Rp/Xp \leqq n+3/4$ (n is a positive integer) where a layout pitch of the concaved portions in a perimeter direction of the cleaning roller is Xp (mm) and a distance between (i) a maximum depth at which the pressing roller is in contact with the cleaning roller and (ii) a rotational central axis of the pressing roller is Rp (mm).

According to the arrangement, in the surface of the pressing roller, the concaved portion can be brought into contact with a middle point between two positions contacted by the concaved portions at the first rotation of the pressing roller by the time when the pressing roller makes three rounds. Thus, an area positioned in the surface of the pressing roller so as to be contacted by the concaved portions is highly densified, so that it is possible to efficiently collect the developer from the surface of the pressing roller.

The fixing device cleaning device may be arranged so that: $\pi \cdot Rp/Xp$ is substantially equal with $n+1/2$ (n is a positive integer) where a layout pitch of the concaved portions in a perimeter direction of the cleaning roller is Xp (mm) and a distance between (i) a maximum depth at which the pressing roller is in contact with the cleaning roller and (ii) a rotational central axis of the pressing roller is Rp (mm).

According to the arrangement, in the surface of the pressing roller, the concaved portion at the second rotation of the pressing roller can be brought into contact with a middle point between two positions contacted by the concaved portions at the first rotation of the pressing roller. Thus, an area positioned in the surface of the pressing roller so as to be contacted by the concaved portions are highly densified, so that it is possible to efficiently collect the developer from the surface of the pressing roller.

The fixing device cleaning device may be arranged so that an internal width of the concaved portion becomes smaller as the concaved portion comes closer to a rotational axis of the cleaning roller.

According to the arrangement, in a capillary phenomenon of the concaved portion, a critical pressure on the side of the roller axis becomes higher than a critical pressure on the side of the cleaning roller surface, so that this induces the fused developer to move to the side of the roller axis in case where the developer is collected by the concaved portions with the developer in a half-fusing state, thereby improving the cleaning function of the concaved portions.

The fixing device cleaning device may be arranged so that the concaved portion includes a minimum width portion, positioned in a radius direction of the cleaning roller, whose width is not more than 1.5 mm.

According to the arrangement, in case where a critical pressure based on the capillary phenomenon of the concaved portion largely increases and the developer is collected by the concaved portions with the developer in a half-fusing state, it is possible to promote the collection of the developer into the concaved portions due to a surface tension.

The fixing device cleaning device may be arranged so that the cleaning roller includes a hollow therein so that the concaved portions are connected to the hollow.

According to the arrangement, it is possible to move toner adhering to the surface of the cleaning roller from the concaved portions to the hollow via the connection sections due to a contact pressure of the pressing roller. Thus, it is possible to keep the cleaning function of the concaved portions over an extended period of time.

The fixing device cleaning device may be arranged so that a width of the minimum width portion of the concaved portion formed on the surface of the cleaning roller is set to be within a range of from 0.3 to 2 mm.

According to the arrangement, the width of the minimum width portion of the concaved portion formed on the surface of the cleaning roller is set to be within a range of from 0.3 to 2 mm, and this range covers a size of paper dusts remaining in the fixing device, so that it is possible to collect not only unnecessary developer adhering to the pressing roller but also the paper dusts. Thus, it is possible to prevent the rear surface of the recording sheet from being tainted by a toner particle clot, having a core made of paper dusts remaining on the surface of the cleaning roller for example, which is exfoliated from the surface of the cleaning roller after growing to be a large particle clot.

Note that, the present invention is applicable to an embodiment in which each of the fixing member and the pressing member is formed not in a roller shape but in a belt shape.

The fixing device cleaning device may be arranged so that a width of an area corresponding to the opening sections formed on the cleaning member is set to be wider than a maximum sheet width processable in the fixing device.

The fixing device cleaning device may be arranged so that each of the opening sections includes an edge portion which slants with respect to a moving direction of the cleaning target surface, and the opening sections are provided in plurality.

According to the arrangement, the strength of the cleaning member is higher than the case where a single opening section is formed. Further, the opening sections are formed so as to slant, so that it is possible to surely provide the opening section in a width direction of the cleaning member.

The fixing device cleaning device may be arranged so that $p/\tan\theta \leqq Wn$ where an angle at which each of the opening sections slants with respect to the moving direction of the cleaning target surface is $\theta$, and a pitch of the opening sections in a width direction is p, and a width at which the cleaning member and the cleaning target surface are in contact with each other in the moving direction of the cleaning target surface is Wn.

According to the arrangement, at least two edge portions provided in an oblique direction are in contact with the cleaning target surface, so that it is possible to improve the cleaning performance of the cleaning member.

The fixing device cleaning device may be arranged so that the opening sections are provided in plurality so as to be in a staggered manner in a moving direction of the cleaning target surface. According to the arrangement, the opening sections are provided in plurality so as to be in a staggered manner, so that it is possible to surely provide the opening sections in the width direction of the cleaning member.

The fixing device cleaning device may be arranged so that the opening sections are in contact with the cleaning target surface.

According to the arrangement, even when there is unevenness in terms of a positional relationship between the cleaning member and the cleaning target surface, it is possible to surely bring the edge of the cleaning member into contact with the cleaning target surface.

The fixing device cleaning device may be arranged so that an end portion of the cleaning member is bent in a direction away from the cleaning target surface.

According to the arrangement, a distance between the end portion of the cleaning member and the cleaning target surface is long, so that it is possible to surely prevent the toner puddle from being formed on the end portion of the cleaning member.

The fixing device cleaning device may be arranged so that an end portion of the cleaning member is divided so as to be a serrated portion.

According to the arrangement, in case where the end portion of the cleaning member is disposed in a forward direction with respect to a moving direction of the cleaning target surface, when the end portion is divided so as to be a serrated portion, there is no portion on which the toner puddle is formed, so that it is possible to surely prevent the toner puddle from being formed.

The fixing device cleaning device may be arranged so that the cleaning member includes a notch portion provided on a part of an outer edge surrounding the opening section.

According to the arrangement, even when the outer edge (frame) surrounding the opening section thermally expands, the thermal extension is absorbed by the notch portion, so that it is possible to prevent the cleaning member from being raised by the thermal extension of the frame, thereby preventing the cleaning member from swinging.

The fixing device of the present invention includes any one of the fixing device cleaning devices, wherein the cleaning member has a contact portion with respect to the cleaning target surface so that the contact portion is disposed perpendicularly or upwardly.

According to the arrangement, a gravity causes foreign substances, removed by the cleaning member, to fall in a direction of the contacted surface from the contacting surface, so that the foreign substances are more inclined to move via the opening sections.

The fixing device according to another arrangement of the present invention includes any one of the aforementioned fixing device cleaning devices, wherein an end portion of the cleaning member is disposed in a forward direction with respect to a moving direction of the cleaning target surface.

According to the arrangement, in case where the cleaning member is disposed in an adverse direction, the cleaning member is supported by a downstream side portion with respect to the contact point to the cleaning target surface of the cleaning member, so that the downstream side portion can be less freely designed and tends to form the toner puddle. However, in case where the cleaning member is disposed in the forward direction, the arrangement is free from the foregoing restriction, so that it is possible to prevent the toner puddle from being formed.

The fixing device according to another arrangement of the present invention includes some of the aforementioned cleaning devices.

According to the arrangement, even when sequential passing of small-size sheets causes the toner puddle to fuse and flow from the cleaning member positioned on the upstream side, the fused toner is collected by the cleaning member positioned on the downstream side again, so that it is possible to surely prevent the recording paper from being tainted.

The fixing device according to another arrangement of the present invention may be arranged so that there is disposed offset prevention agent applying means for applying an offset prevention agent to the surface of the heating member or the pressing member provided with the cleaning member.

According to the arrangement, the offset prevention agent adheres to the cleaning member, so that a force with which the foreign substances adhere to the cleaning member is weakened. As a result, the foreign substances are more likely to move via the opening sections.

Particularly, even in case where small-size sheets are sequentially passed, the offset prevention agent applied to the non-sheet passing area does not move to the recording paper, so that more offset prevention agent adheres to the non-sheet passing area of the cleaning member than that of the sheet passing area, so that this condition facilitates movement of the toner puddle through the opening sections. As a result, even in case where the small-size sheets are passed, it is possible to surely prevent the recording paper from being tainted by the fused toner puddle.

The fixing device may be arranged so that at least one of the cleaning devices is disposed on a downstream side with respect to the offset prevention agent applying means.

According to the arrangement, the offset prevention agent adheres to the cleaning member before moving to the recording paper, so that it is possible to allow the foreign substances to more smoothly pass through the opening sections with the offset prevention agent. Further, even when the offset prevention agent applying means is tainted with toner and paper dusts as time elapses and these foreign substances flow to the fixing member, the foreign substances are collected by the cleaning member positioned on the downstream side, so that it is possible to prevent the recording paper from being tainted.

The fixing device may be arranged so that includes external heating means for heating the surface of the heating member or the pressing member, provided with the cleaning device, from outside, wherein the cleaning device and the external heating means are disposed close to each other.

According to the arrangement, also the cleaning member is secondarily heated by heat emitted from the external heating means, so that temperature of the cleaning member is kept higher than that of the conventional one, thereby preventing the opening sections from being clogged by the fixed toner.

The image forming device of the present invention includes a fixing device provided with any one of the aforementioned cleaning devices.

The image forming device may be arranged so that an image is formed by using developer whose pigment concentration is not less than 7%.

In the image forming device of the present invention, even when an amount of the consumed developer is reduced by using the developer whose pigment concentration is not less than 7%, unnecessary developer can be collected by the cleaning device, so that it is possible to reduce the running cost. That is, pigment concentration of general developer (for example, toner) ranges from 3 to 4%. However, it is possible to reduce the amount of the consumed developer by setting the pigment concentration to be not less than 7%.

While, when the pigment concentration is raised, the viscosity of the fused developer rises. As a result, it is general that the cleaning roller less efficiently move and collect the developer. However, according to the arrangement of the present invention, the concaved portions are formed on the cleaning roller, and the concaved portions enable the developer to be efficiently collected, so that it is possible to appropriately collect the developer whose viscosity has been raised. Alternatively, the opening sections are formed on the scraper-shape cleaning member, and the foreign substances scraped by the cleaning member move to a surface (rear surface with respect to the surface which is in contact with the cleaning target surface) of the cleaning member via the opening sections, so that the foreign substances are not deposited on a gap between the cleaning member and the cleaning target surface, thereby appropriately collecting the developer whose viscosity has been raised.

Further, the fixing device cleaning device may be arranged so that the fixing device cleaning device includes a cleaning roller which is pressed against the pressing roller so as to remove the developer from a surface of the pressing roller, and a plurality of concaved portions are formed on a surface of the cleaning roller.

Thus, unnecessary developer remaining on the surface of the pressing roller is collected by the plurality of concaved portions formed on the surface of the cleaning roller, so that it is possible to more quickly collect unnecessary developer than such a conventional arrangement that the developer is merely discharged from axis-direction both ends of the cleaning roller. Thus, in case where images are sequentially printed on wide sheets or in case where images are sequentially printed by means of a high speed machine, unnecessary developer is appropriately collected from the heating roller and the pressing roller, so that it is possible to surely prevent front and rear surfaces of the recording paper from being tainted.

Further, the cleaning device of the present invention includes a cleaning member, formed in a scraper shape, which is pressed against the heating member or the pressing member so as to remove the developer from a surface of the heating member or the pressing member, said cleaning member including one or more opening sections in a vicinity of a contact point with respect to a cleaning target surface of the heating member or the pressing member.

Thus, the foreign substances scraped by the cleaning member move to a surface (rear surface with respect to the surface which is in contact with the cleaning target surface) of the cleaning member via the opening sections, so that the foreign substances are not deposited on a gap between the cleaning member and the cleaning target surface, thereby preventing the deposited foreign substances from adhering to the cleaning target surface. Further, the opening sections generally cause the cleaning member made of elastic material to be less likely to spring, so that the cleaning member can be pressed against the heating member or the pressing member at a lower pressure than that of the conventional one. As a result, it is possible to reduce a load exerted to the cleaning target surface. Further, even when the cleaning member thermally expands, the thermal expansion is absorbed by the opening sections, so that it is possible to prevent the cleaning member from being swung by heat. As a result, it is possible to stably bring the whole width of the cleaning member into contact with the cleaning target surface.

The present invention can be used in a fixing device of an electrophotographic device or the like, such as a copying machine and a printer.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A fixing device cleaning device, provided on a fixing device which includes:

a heating member heated by heating means; and a pressing member pressed against the heating member at a predetermined contact pressure, a recording sheet being sandwiched by a pressing section of the heating member and a pressing section of the pressing member, developer on the recording sheet being fixed, said fixing device cleaning device comprising a cleaning member, formed in a scraper shape, which is pressed against the heating member or the pressing member so as to remove the developer from a surface of the heating member or the pressing member, wherein the cleaning member includes one or more opening sections and a contact point of the cleaning member with respect to a cleaning target surface of the heating member or the pressing member is in a portion of the cleaning member where the one or more opening sections exist.

2. The fixing device cleaning device as set forth in claim 1, wherein a width of an area corresponding to the opening sections formed on the cleaning member is set to be wider than a maximum sheet width processable in the fixing device.

3. The fixing device cleaning device as set forth in claim 2, wherein each of the opening sections includes an edge portion which slants with respect to a moving direction of the cleaning target surface, and the opening sections are provided in plurality.

4. The fixing device cleaning device as set forth in claim 3, wherein $$p/\tan\theta \leqq Wn$$

where an angle at which each of the opening sections slants with respect to the moving direction of the cleaning target surface is θ, and a pitch of the opening sections in a width direction is p, and a width at which the cleaning member and the cleaning target surface are in contact with each other in the moving direction of the cleaning target surface is Wn.

5. The fixing device cleaning device as set forth in claim 3, wherein the opening sections are in contact with the cleaning target surface.

6. The fixing device cleaning device as set forth in claim 2, wherein the opening sections are provided in plurality so as to be in a staggered manner in a moving direction of the cleaning target surface.

7. The fixing device cleaning device as set forth in claim 2, wherein an end portion of the cleaning member is bent in a direction away from the cleaning target surface.

8. The fixing device cleaning device as set forth in claim 2, wherein an end portion of the cleaning member is divided so as to be a serrated portion.

9. The fixing device cleaning device as set forth in claim 2, wherein the cleaning member includes a notch portion provided on a part of an outer edge surrounding the opening section.

10. The fixing device cleaning device as set forth in claim 1, wherein each of the opening sections includes an edge portion which slants with respect to a moving direction of the cleaning target surface, and the opening sections are provided in plurality.

11. The fixing device cleaning device as set forth in claim 10, wherein $$p/\tan\theta \leqq Wn$$

where an angle at which each of the opening sections slants with respect to the moving direction of the cleaning target surface is θ, and a pitch of the opening sections in a width direction is p, and a width at which the cleaning member and the cleaning target surface are in contact with each other in the moving direction of the cleaning target surface is Wn.

12. The fixing device cleaning device as set forth in claim 10, wherein the opening sections are in contact with the cleaning target surface.

13. The fixing device cleaning device as set forth in claim 1, wherein the opening sections are provided in plurality so as to be in a staggered manner in a moving direction of the cleaning target surface.

14. The fixing device cleaning device as set forth in claim 1, wherein an end portion of the cleaning member is bent in a direction away from the cleaning target surface.

15. The fixing device cleaning device as set forth in claim 1, wherein an end portion of the cleaning member is devided so as to be a serrated portion.

16. The fixing device cleaning device as set forth in claim 1, wherein the cleaning member includes a notch portion provided on a part of an outer edge surrounding the opening section.

17. A fixing device, comprising: a heating member heated by heating means; and a pressing member pressed against the heating member at a predetermined contact pressure, a recording sheet being sandwiched by a pressing section of the heating member and a pressing section of the pressing member, developer on the recording sheet being fixed, said fixing device comprising a fixing device cleaning device which includes: a cleaning member, formed in a scraper shape, which is pressed against the heating member or the pressing member so as to remove the developer from a surface of the heating member or the pressing member, said cleaning member including one or more opening sections and a contact point of the cleaning member with respect to a cleaning target surface of the heating member or the pressing member is in a portion of the cleaning member where the one or more opening sections exist, wherein the cleaning member has a contact portion with respect to the cleaning target surface so that the contact portion is disposed perpendicularly or upwardly.

18. The fixing device as set forth in claim 17, wherein there is disposed offset prevention agent applying means for applying an offset prevention agent to the surface of the heating member or the pressing member provided with the cleaning member.

19. The fixing device as set forth in claim 17, wherein at least one of the cleaning devices is disposed on a downstream side with respect to the offset prevention agent applying means.

20. The fixing device as set forth in claim 17, comprising external heating means for heating the surface of the heating member or the pressing member, provided with the cleaning device, from outside, wherein the cleaning device and the external heating means are disposed close to each other.

* * * * *